US005190853A

United States Patent [19]

Seto et al.

[11] Patent Number: 5,190,853

[45] Date of Patent: Mar. 2, 1993

[54] SILVER HALIDE COLOR PHOTOSENSITIVE MATERIAL

[75] Inventors: Nobuo Seto; Masakazu Morigaki, both of Kanagawa, Japan

[73] Assignee: Fuji Photo Film Co., Ltd., Minami-ashigara, Japan

[21] Appl. No.: 440,298

[22] Filed: Nov. 22, 1989

[30] Foreign Application Priority Data

Nov. 22, 1988 [JP] Japan ..... 63-295812
Nov. 30, 1988 [JP] Japan ..... 63-302587

[51] Int. Cl.[5] ..... G03C 1/06

[52] U.S. Cl. ..... 430/551; 430/264; 430/505; 430/556; 430/557; 430/567; 430/598; 430/607

[58] Field of Search ..... 430/551, 556, 557, 613, 430/607, 505, 567, 264, 598

[56] References Cited

U.S. PATENT DOCUMENTS

| | | | |
|---|---|---|---|
| 3,227,554 | 1/1966 | Barr et al. | 430/505 |
| 3,761,266 | 9/1973 | Milton | 430/598 |
| 4,383,027 | 5/1983 | Ishikawa et al. | 430/551 |
| 4,456,682 | 6/1984 | Ishikawa et al. | 430/523 |
| 4,522,917 | 6/1985 | Ichijima et al. | 430/613 |
| 4,745,050 | 5/1988 | Seto et al. | 430/551 |
| 4,871,653 | 10/1989 | Inoue et al. | 430/409 |
| 4,873,173 | 10/1989 | Sasaoka et al. | 430/598 |

FOREIGN PATENT DOCUMENTS

| | | | |
|---|---|---|---|
| 62-27731 | 5/1987 | Japan . | |
| 1-147455 | 6/1989 | Japan | 430/505 |

*Primary Examiner*—Charles L. Bowers, Jr.
*Assistant Examiner*—Thorl Chea
*Attorney, Agent, or Firm*—Burns, Doane, Swecker & Mathis

[57] ABSTRACT

A silver halide color photosensitive material is disclosed. The photosensitive material comprises a support and a hydrophilic colloidal layer containing a yellow coupler. According to the present invention, the layer further contains a color image stabilizer in an amount of 10 to 200 mole % based on the amount of the yellow coupler. The color image stabilizer and the yellow coupler are together contained in droplets of a medium which are dispersed in the layer. The color image stabilizer is an organic compound having the following formula [I] or [II]:

[I]

[II]

in which each of $R^1$, $R^2$, $R^3$ and $R^4$ independently is hydrogen, an alkyl group, an alkenyl group, an aryl group, a heterocyclic group, an alkoxycarbonyl group, an aryloxycarbonyl group, an acyl group, a sulfonyl group, a sulfinyl group, a phosphoryl group, a carbamoyl group or a sulfamoyl group; each of $R^5$ and $R^6$ independently is hydrogen, an alkyl group, a cycloalkyl group, an alkenyl group, a cycloalkenyl group, an aryl group, a heterocyclic group, an acyl group, a sulfonyl group, a phosphoryl group, a sulfinyl group, an alkylcarbamoyl group, an arylcarbamoyl group, an alkylsulfamoyl group, an arylsulfamoyl group, an alkoxycarbonyl group or an aryloxycarbonyl group; and Y is a non-metallic atomic group which forms, together with the two nitrogen atoms, a 5- to 8-membered heterocyclic ring.

11 Claims, No Drawings

SILVER HALIDE COLOR PHOTOSENSITIVE MATERIAL

FIELD OF THE INVENTION

The present invention relates to a silver halide photosensitive material, and particularly to a silver halide color photosensitive material which is protected from a fading of a yellow color image.

BACKGROUND OF THE INVENTION

It has been well known that a silver halide color photosensitive material forms a dye image by an imagewise exposure of the photosensitive material to light and a color development of the material. The dyes in the obtained image, such as indophenol, indoaniline, indamine, azomethine, phenoxazine and phenazine dyes are formed by a reaction of an oxidized aromatic primary amine color developing agent with a coupler in the color development.

In general, the quality of the obtained photographic image is not perpetual, and is gradually degraded while the photograph is preserved. A color photograph having an image made of an azomethine or indoaniline dye is particularly apt to be degraded. The degradation of the image is caused by a fading or discoloration of the dye image or a discoloration on a white ground (yellow stain), when the photograph is irradiated with light for a long term, or preserved at a high temperature and humidity.

The degradation of the image quality is a serious disadvantage. An improvement is desirable to overcome the disadvantage.

A color photograph generally contains cyan, magenta and yellow dye images. Each of the dye images has been independently investigated to stabilize the photograph. The magenta dye image has been particularly well investigated. The yellow dye image has not been so well investigated as the magenta dye image, since the yellow dye image was relatively stable compared with the magenta dye image. However, the stability of the magenta dye image has recently been so much improved as the results of the investigation that a fading or discoloration of the yellow dye image now becomes remarkable. Accordingly, it is now desirable to stabilize the yellow dye image.

The use of a color image stabilizer has been proposed to improve the stability of the yellow dye image to light, heat or humidity. For example, hindered amine derivatives and phenol derivatives are disclosed in U.S. Pat. Nos. 4,452,884 and No. 4,465,765, and Japanese Patent Provisional Publications No. 54(1979)-48535, No. 59(1984)-3433, No. 59(1984)-5246, No. 59(1984)-87456, No. 61(1986)-2151 and No. 61(1986)-86750; spirochroman derivatives are disclosed in Japanese Patent Publication No. 59(1984)-52825; and amines other than hydrazines are disclosed in Japanese Patent Provisional Publications No. 63(1988)-149642, No. 63(1988)-149643, No. 63(1988)-149645 and No. 63(1988)-163347.

In order to improve the stability of a yellow dye to light or heat, the compounds disclosed in the above-mentioned publications have an effect on the dye to some extent. However, the effect is relatively weak or is accompanied by a bad effect on the quality of the photograph.

Further, the use of hydrazine derivatives is proposed in European Patent No. 255,722 and Japanese Patent Provisional Publication No. 63(1988)-220142. The compounds disclosed in European Patent No. 255,722 react with a developing agent which remains in a color photosensitive material after the development process to remove the remaining developing agent, which causes a fading. Accordingly, the effect of these compounds on dyes to prevent the fading is weak because they do not directly reacts with the dyes. The compounds disclosed in Japanese Patent Provisional Publication No. 63(1988)-220142 have some bad influences on the the quality of the photograph. For example, they inhibit the color development reaction of a coupler or cause a fog within the unexposed area.

In contrast to the yellow dye image, various color image stabilizers have been proposed to improve the stability of the magenta dye image. Most of the color image stabilizers do not have any effect on the yellow dye image, and has the effect only on the magenta dye image. Moreover, many of the color image stabilizers adversely accelerate the fading of the yellow dye image.

SUMMARY OF THE INVENTION

An object of the present invention is to provide a silver halide color photosensitive material which is improved in the stability of the yellow dye image.

Another object of the invention is to provide a silver halide color photosensitive material in which the yellow image can be stabilized by incorporating into a photographic layer a stabilizer which has a sufficient effect on the yellow dye image to improve the stability of the image without any of the change of hue, the occurrence of fog, the bad influence on disperse phase and the crystallization.

A further object of the invention is to provide a silver halide color photosensitive material which is improved in the color balance with respect to the fading of three colors by the improvement of the stability of the yellow dye image to light or heat.

In the course of studies of the present inventors, it is found that the above-mentioned objects are attained by a silver halide color photosensitive material of the present invention, which comprises a support and a hydrophilic colloidal layer containing a yellow coupler, wherein the layer further contains a color image stabilizer in an amount of 10 to 200 mole % based on the amount of the yellow coupler, said color image stabilizer and said yellow coupler being together contained in droplets of a medium which are dispersed in the layer, and said color image stabilizer being an organic compound containing at least two nitrogen atoms represented by the following formula [I] or [II]:

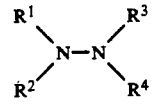

[I]

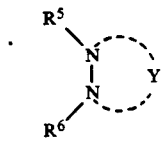

[II]

in which each of $R^1$, $R^2$, $R^3$ and $R^4$ independently is a group selected from the group consisting of hydrogen, an alkyl group, an alkenyl group, an aryl group, a heterocyclic group, an alkoxycarbonyl group, an aryloxycarbonyl group, an acyl group, a sulfonyl group, a sulfinyl group, a phosphoryl group, a carbamoyl group and a sulfamoyl group; $R^1$ and $R^2$, or $R^3$ and $R^4$ may form, together with the nitrogen atom, a 5-to 8-membered heterocyclic ring; two or more compounds having the formula [I] may be combined with each other at the position of $R^1$, $R^2$, $R^3$ or $R^4$ to form a polymer; the number of the total carbon atoms contained in $R^1$, $R^2$, $R^3$ and $R^4$ is not less than 6; neither $R^1$ and $R^2$ nor $R^3$ and $R^4$ form a heterocyclic ring which consists of the nitrogen atom, an alkylene group, a hetero atom, an alkylene group and the other nitrogen atom in the order; when one of $R^1$ and $R^2$ is hydrogen, the other is not an arylsulfonyl group; when one of $R^3$ and $R^4$ is hydrogen, the other is not an arylsulfonyl group; each of $R^1$, $R^2$, $R^3$ and $R^4$ is neither a residue of a coupler nor a reducing agent; each of $R^5$ and $R^6$ independently is a group selected from the group consisting of hydrogen, an alkyl group, a cycloalkyl group, an alkenyl group, a cycloalkenyl group, an aryl group, a heterocyclic group, an acyl group, a sulfonyl group, a phosphoryl group, a sulfinyl group, an alkylcarbamoyl group, an arylcarbamoyl group, an alkylsulfamoyl group, an arylsulfamoyl group, an alkoxycarbonyl group and an aryloxycarbonyl group; Y is a non-metallic atomic group which forms, together with the two nitrogen atoms, a 5- to 8-membered heterocyclic ring; Y does not form a heterocyclic ring which consists of the two nitrogen atoms, an alkylene group, a hetero-atom and an alkylene group in the order; Y does not form a perhydro-1,2,4,5-tetrazine ring; when Y forms 1-phenyl-3-pyrazolidone, neither hydrogen, acetyl nor an acyl group substituted with carboxyl is placed at the 2-position of 1-phenyl-3-pyrazolidone.

With respect to the compound having the formula [I], it is preferred that one of $R^1$ and $R^2$ is not hydrogen, and one of $R^3$ and $R^4$ is not hydrogen. It is further preferred that each of $R^1$, $R^2$, $R^3$ and $R^4$ independently contains not more than 40 carbon atoms, and the number of the total carbon atoms contained in $R^1$, $R^2$, $R^3$ and $R^4$ is 6 to 50.

With respect to the compound having the formula [II], it is preferred that each of $R^5$ and $R^6$ independently contains not more than 40 carbon atoms, and the number of the total carbon atoms contained in $R^5$ and $R^6$ is 6 to 50.

DETAILED DESCRIPTION OF THE INVENTION

There is no specific limitation with respect to the yellow coupler contained in the silver halide color photosensitive material of the present invention. The preferred yellow coupler is a compound having the following formula [Y-I].

$$R^{12}-\underset{\underset{X^1}{|}}{COCH}-R^{11} \qquad \text{[Y-I]}$$

in which $R^{11}$ is N-phenylcarbamoyl, which may have one or more substituent groups; $R^{12}$ is an alkyl group containing 1–20 carbon atoms or phenyl, each of which may have one or more substituent groups, $X^1$ is hydrogen or a group which may be eliminated in the coupling reaction with an oxidation product of a developing agent; and two or more compounds having the formula [Y-I] may be combined with each other at the position of $R^{11}$, $R^{12}$ or $X^1$ to form a polymer.

The compound having the formula *Y-I] is hereinafter described in more detail.*

The substituent groups of $R^{11}$ (i.e., N-phenylcarbamoyl) are the known substituent groups of a yellow coupler, such as an alkyl group, an alkenyl group, an alkoxy group, an alkoxycarbonyl group, a halogen atom, an alkoxycarbonyl group, an aliphatic amido group, an alkylsulfamoyl group, an alkylsulfonamido group, an alkylureido group, an alkylsuccinimido group, an aryloxy group, an aryloxycarbonyl group, an arylcarbamoyl group, an arylamido group, an arylsulfamoyl group, an arylsulfonamido group, an arylureido group, carboxyl, sulfo, nitro, cyano and thiocyano. $R^{11}$ may have two or more substituent groups, which may be different from each other.

Examples of the alkyl group (including the substituted alkyl group) containing 1–20 carbon atoms represented by $R^{12}$ include methyl, t-butyl, t-amyl, t-octyl, 1,1-diethylpropyl, 1,1-dimethylhexyl, 1,1,5,5-tetramethylhexyl, 1-methylcyclohexyl and adamantyl. Examples of the substituent groups of phenyl represented by $R^{12}$ are the same as the examples of the substituent groups of $R^{11}$.

It is preferred that $X^1$ is an elimination coupling group which forms a two equivalent yellow coupler rather than hydrogen. Examples of the elimination coupling group are shown in the following formulas [Y-II], [Y-III], [Y-IV]and [Y-V].

$$\overset{|}{OR^{26}} \qquad \text{[Y-II]}$$

in which $R^{26}$ is an aryl group or a heterocyclic group, each of which may have one or more substituent groups.

[Y-III]

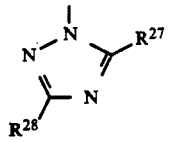

[Y-IV]

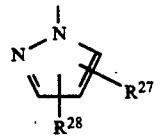

in which each of $R^{27}$ and $R^{28}$ independently is hydrogen, a halogen atom, an acyloxy group, amino, an alkyl group, an alkylthio group, an alkoxy group, an alkylsulfonyl group, an alkylsulfinyl group, carboxyl, sulfo, phenyl which may have one or more substituent groups or a heterocyclic group; n aliphatic group, an aromatic group or a heterocyclic group; and $R^{27}$ and $R^{28}$ may be different from each other.

[Y-V]

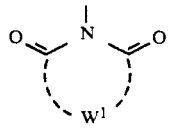

in which $W^1$ is a non-metallic atomic group which forms, together with

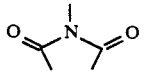

the formula, a 4-, 5- or 6-membered heterocyclic ring.

The more preferred yellow coupler used in the present invention has the following formula [Y-VI].

[Y-VI]

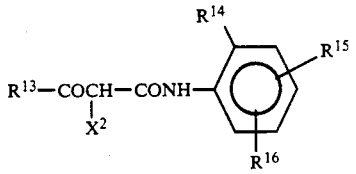

in which $R^{13}$ is an tertiary alkyl group containing 4–12 carbon atoms, phenyl or a phenyl group substituted with a halogen atom, an alkyl group or an alkoxy group; $R^{14}$ is a halogen atom or a alkoxy group; $R^{15}$ is hydrogen, a halogen atom or an alkoxy group which may have one or more substituent groups; and $R^{16}$ is an acylamino group, an alkoxycarbonyl group, an alkylsulfamoyl group, an arylsulfamoyl group, a alkylsulfonamido group, an arylsulfonamido group, an alkylureido group, a succinimido group, an alkoxy group or an aryloxy group, each of which may have one ore more substituent groups; and $X^2$ is a group having the following formula [Y-VII], [Y-VIII], [Y-IX]or [Y-X].

[Y-VII]

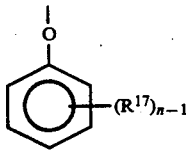

in which $R^{17}$ is an alkylsulfonyl group, an arylsulfonyl group, an acyl group, hydroxyl or the groups represented by $R^{11}$ in the formula [Y-I], each of which may have one or more substituent groups; n is 2, 3, 4 or 5; and when n is 3 or more, the groups represented by $R^{17}$ may be different from each other.

[Y-VIII]

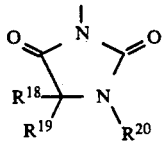

-continued

[Y-IX]

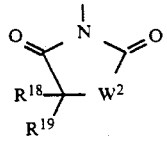

[Y-X]

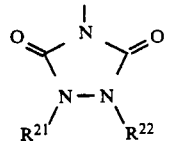

in which each of $R^{18}$ and $R^{19}$ independently is hydrogen, an alkyl group, an aryl group, an alkoxy group, an aryloxy group or hydroxyl; each of $R^{20}$, $R^{21}$ and $R^{22}$ independently is hydrogen, an alkyl group, an aryl group, an aralkyl group or an acyl group; $W^2$ is oxygen or sulfur.

The most preferred yellow coupler used in the present invention has the following formula [Y-XI].

[Y-XI]

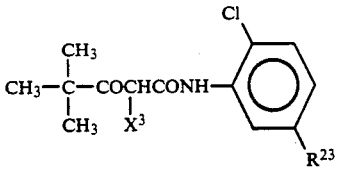

in which $R^{23}$ is an acylamino group, an alkoxycarbonyl group, an alkylsulfamoyl group or an alkylsulfonamido group, each of which may have one or more substituent groups; $X^3$ is a group having the following formula [Y-XII] or the above-mentioned formula [Y-VIII], [Y-IX] or [Y-X].

[Y-XII]

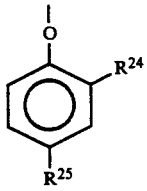

in which $R^{24}$ is hydrogen, a halogen atom, cyano, an acylamino group, an alkylsulfamoyl group, an arylsulfamoyl group, an alkylsulfonyl group or an arylsulfonyl group, each of which may have one or more substituent groups; $R^{25}$ is hydrogen, cyano, an alkylsulfonyl group, an arylsulfonyl group, an alkylsulfamoyl group, an arylsulfamoyl group, an alkylsulfonamido group, an arylsulfonamido group, an acyl group, an alkoxycarbonyl group, an aryloxycarbonyl group or carboxyl, each of which may have one or more substituent groups; and at least one of $R^{24}$ and $R^{25}$ is an alkylsulfonyl group, an arylsulfonyl group, an alkylsulfamoyl group, an arylsulfamoyl group, an alkylsulfonamido group, an arylsulfonamido group, an alkoxycarbonyl group, an aryloxycarbonyl group or carboxyl, each of which may have one or more substituent groups.

Examples of the yellow coupler having the formula [Y-I] used in the present invention are described hereinafter without limiting the invention.

(Y-1)
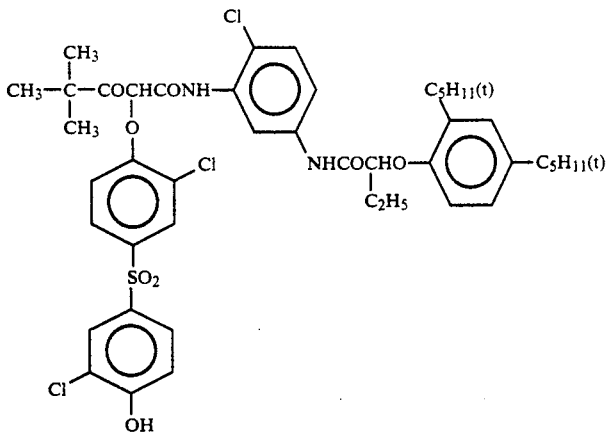
(Y-2)
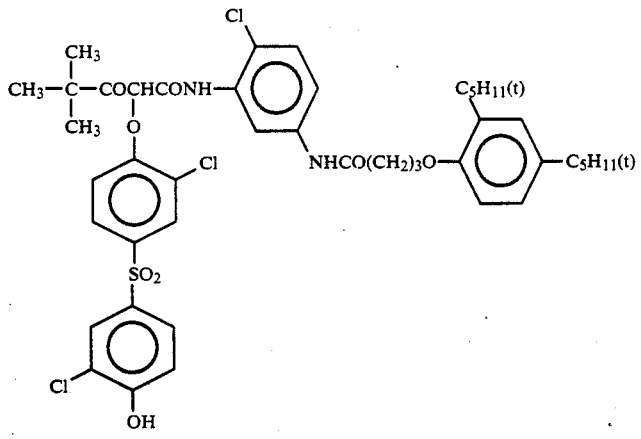
(Y-3)
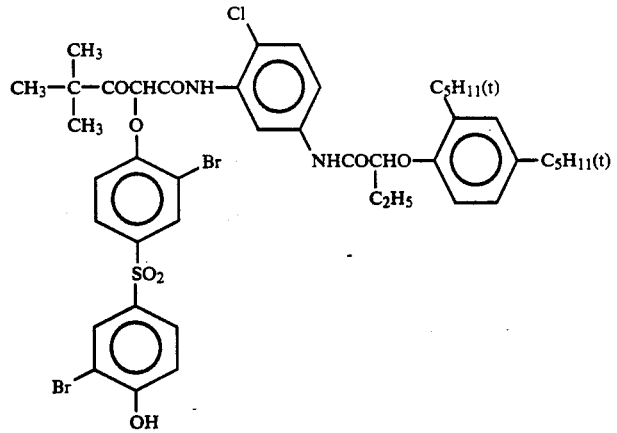
(Y-4)
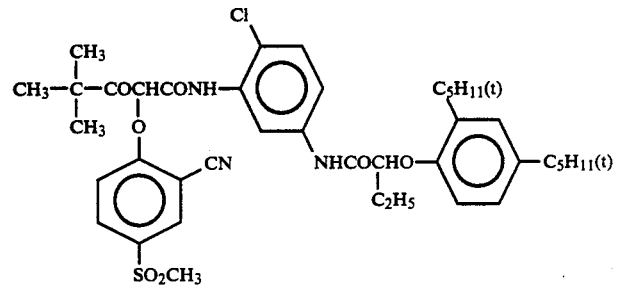

-continued
(Y-5)
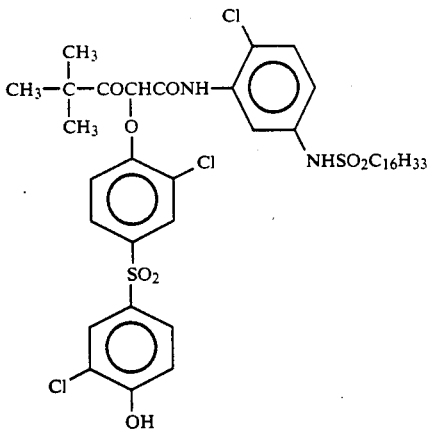
(Y-6)
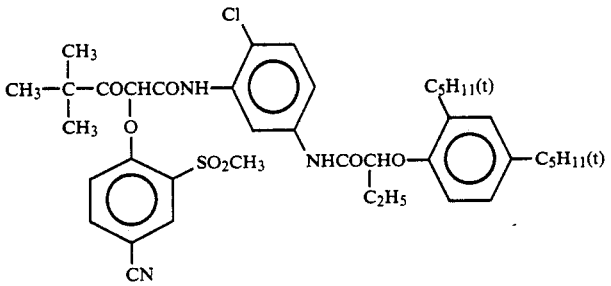
(Y-7)
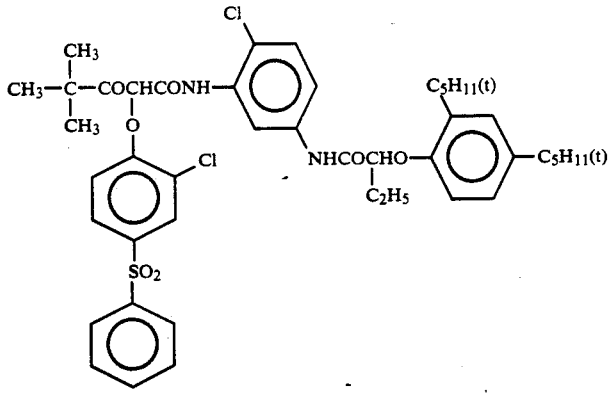
(Y-8)
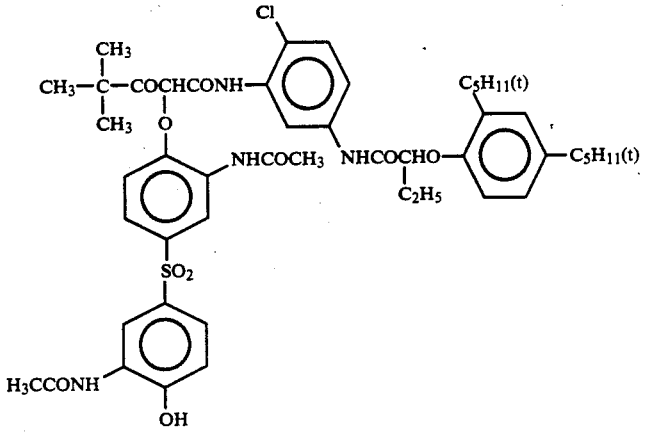

-continued
(Y-9)
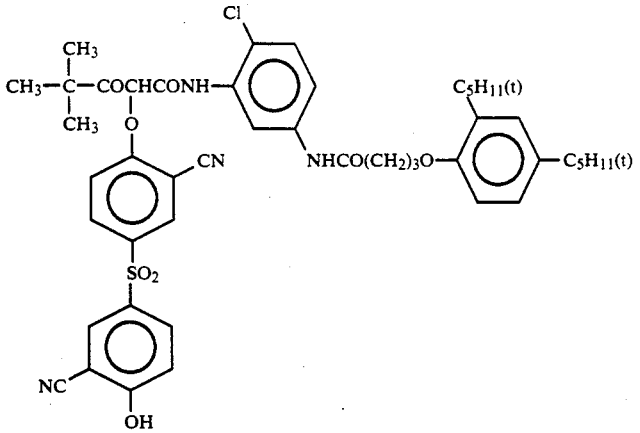
(Y-10)
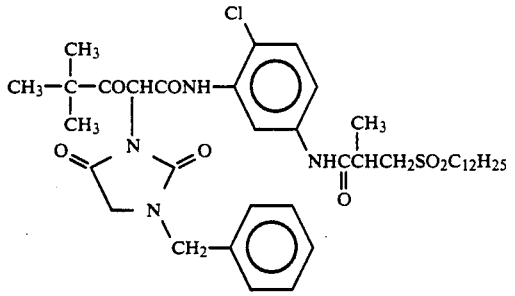
(Y-11)
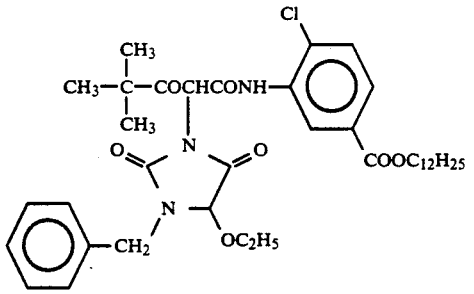
(Y-12)
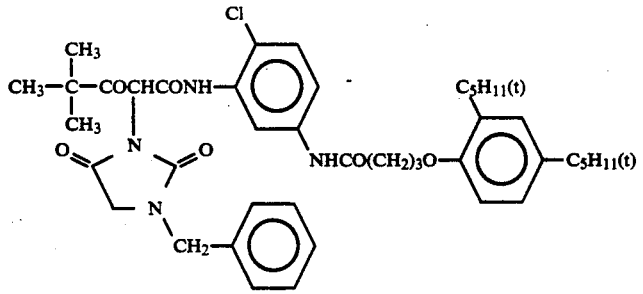
(Y-13)
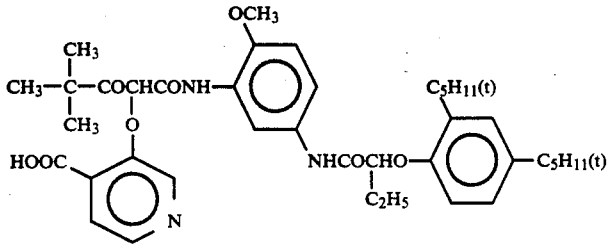

-continued
(Y-14)
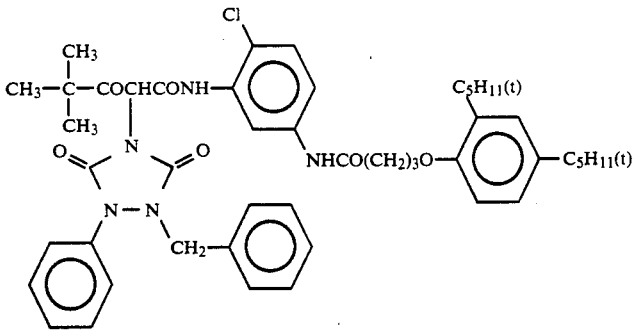
(Y-15)
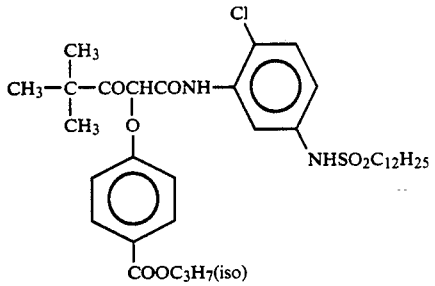
(Y-16)
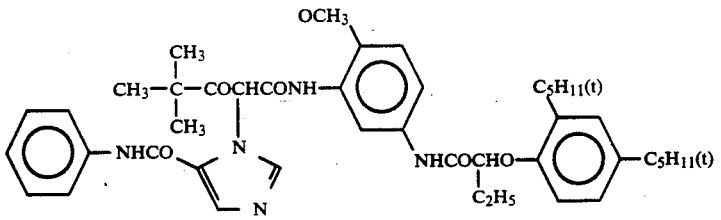
(Y-17)
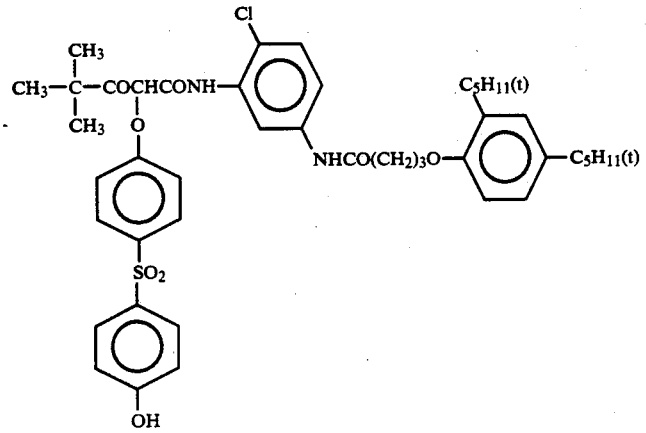

-continued
(Y-18)
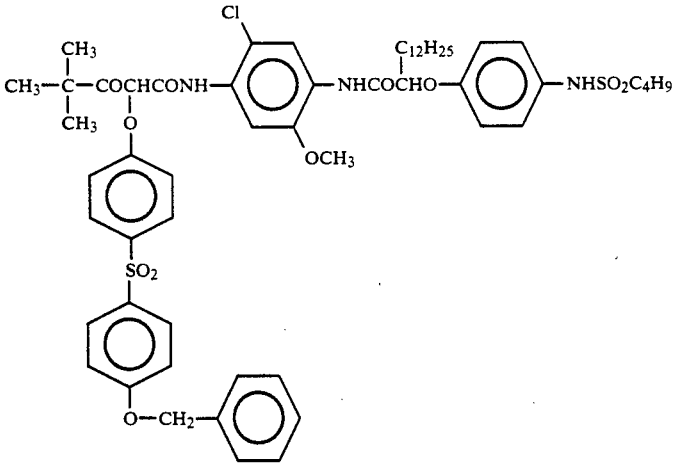
(Y-19)
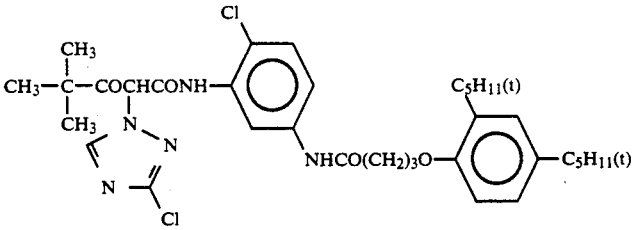
(Y-20)
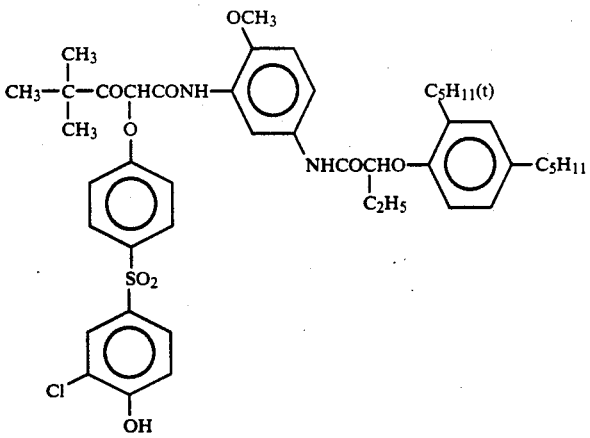
(Y-21)
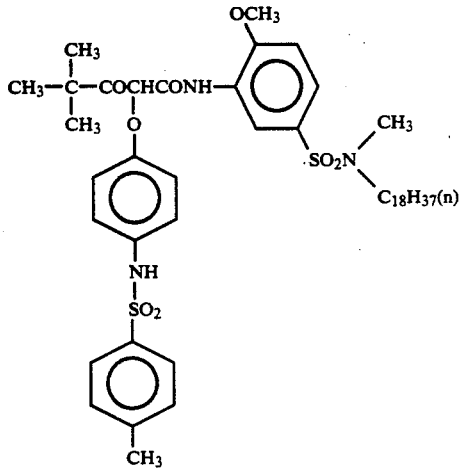

-continued
(Y-22)
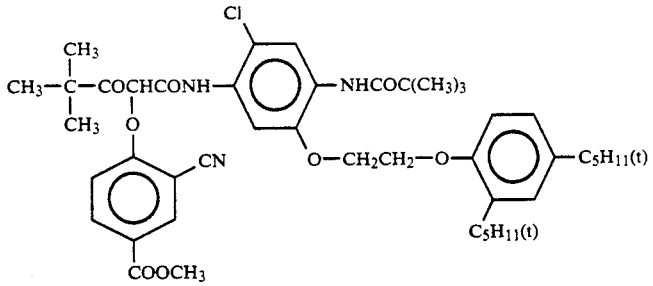
(Y-23)
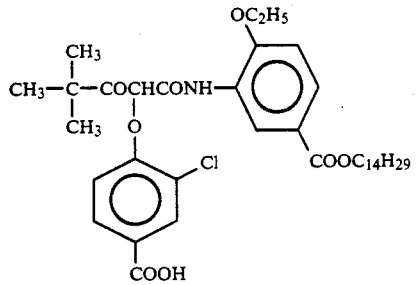
(Y-24)
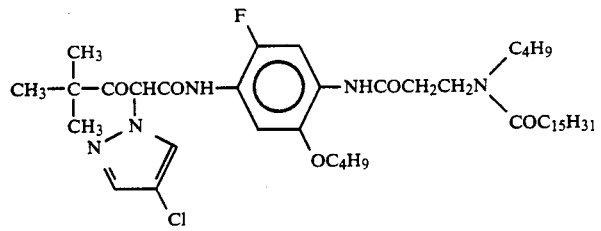
(Y-25)
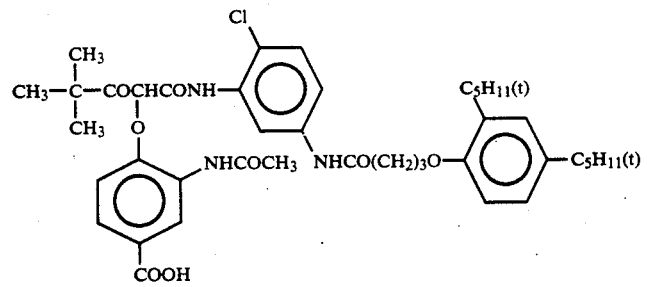
(Y-26)
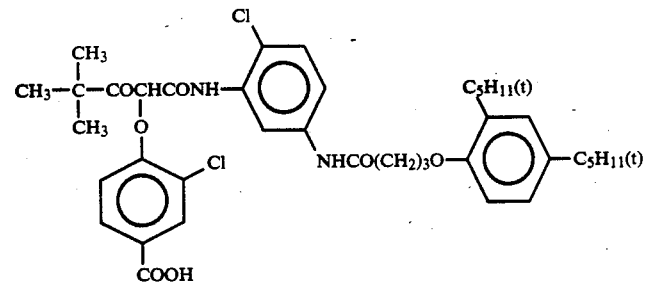
(Y-27)
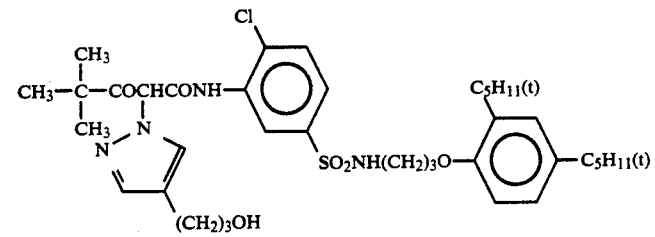

-continued
(Y-28)
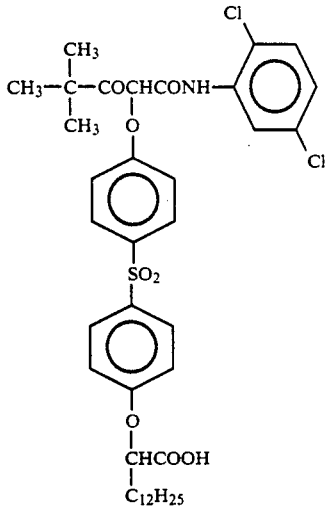
(Y-29)
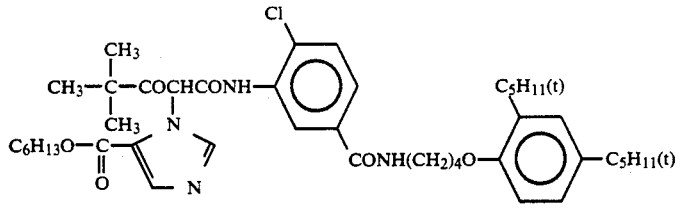
(Y-30)
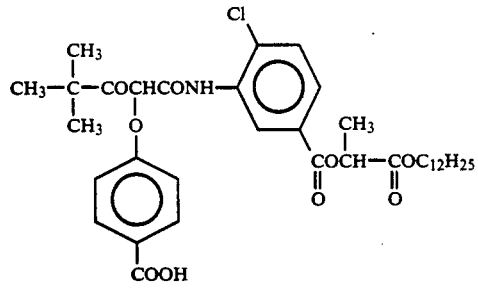
(Y-31)
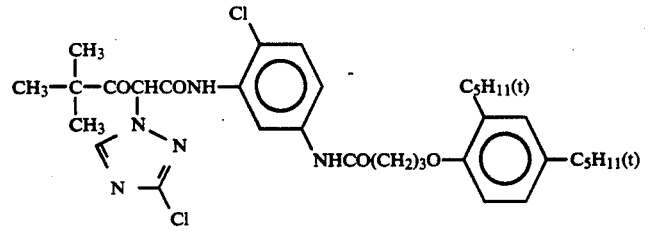
(Y-32)
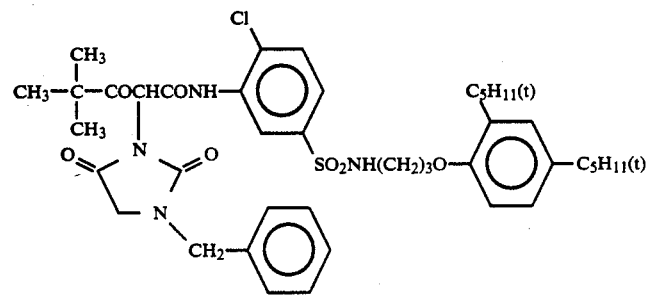

-continued
(Y-33)
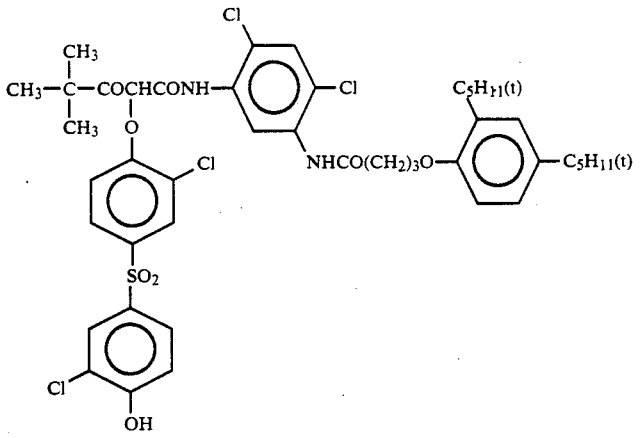
(Y-34)
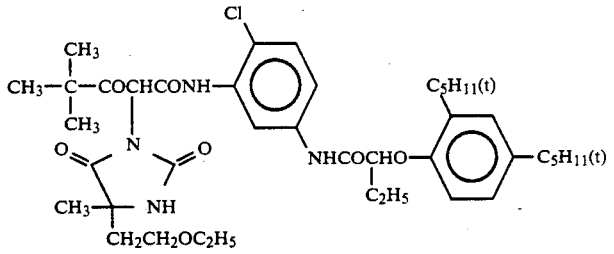
(Y-35)
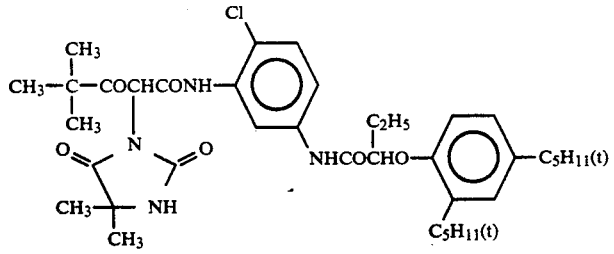
(Y-36)
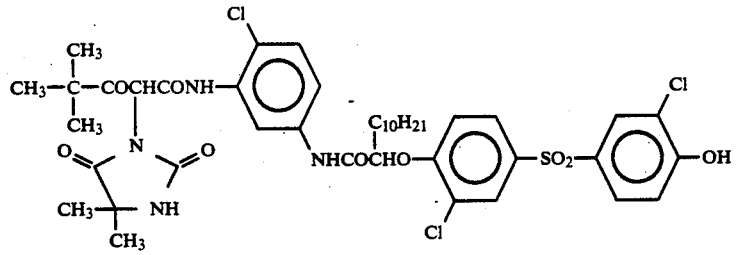
(Y-37)
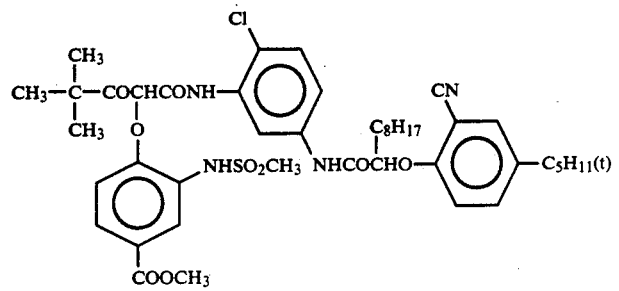

-continued
(Y-38)
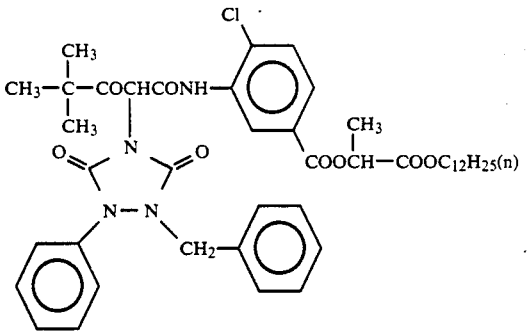
(Y-39)
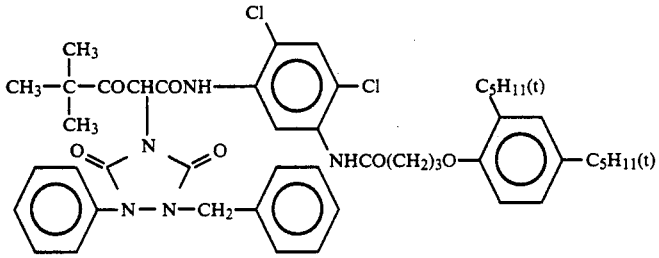
(Y-40)
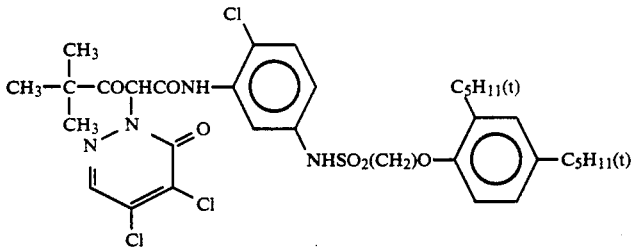
(Y-41)
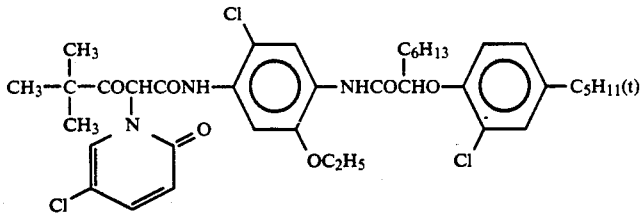
(Y-42)
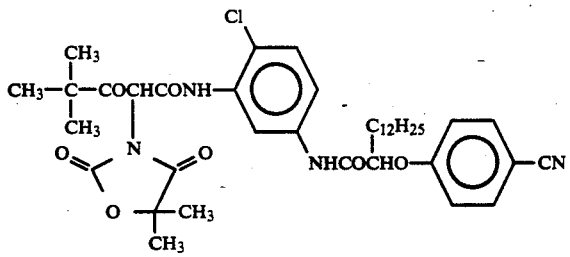
(Y-43)
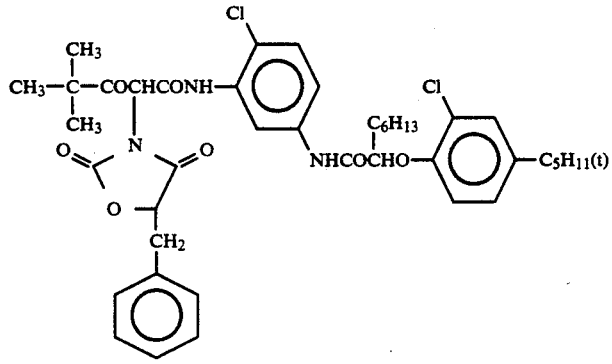

-continued
(Y-44)
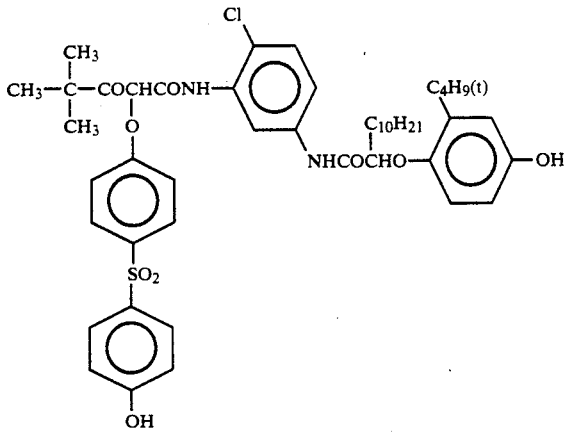
(Y-45)
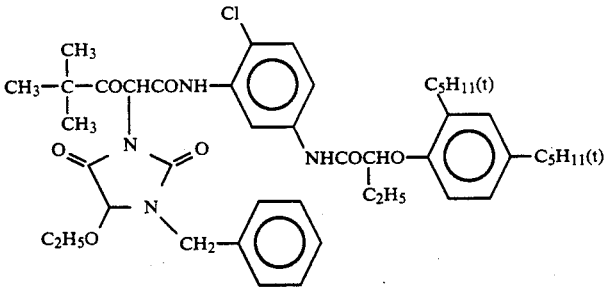
(Y-46)
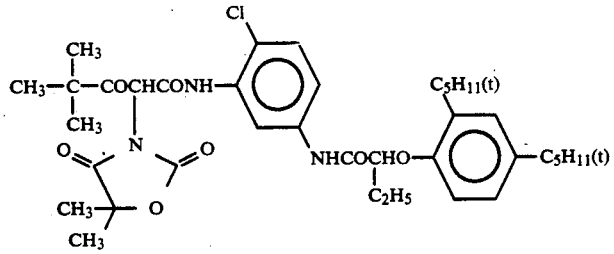
(Y-47)
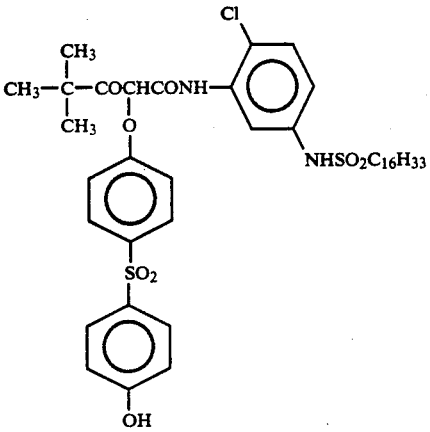

-continued
(Y-48)
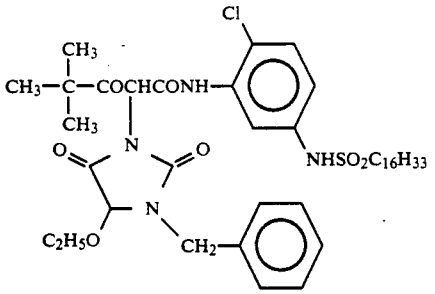
(Y-49)
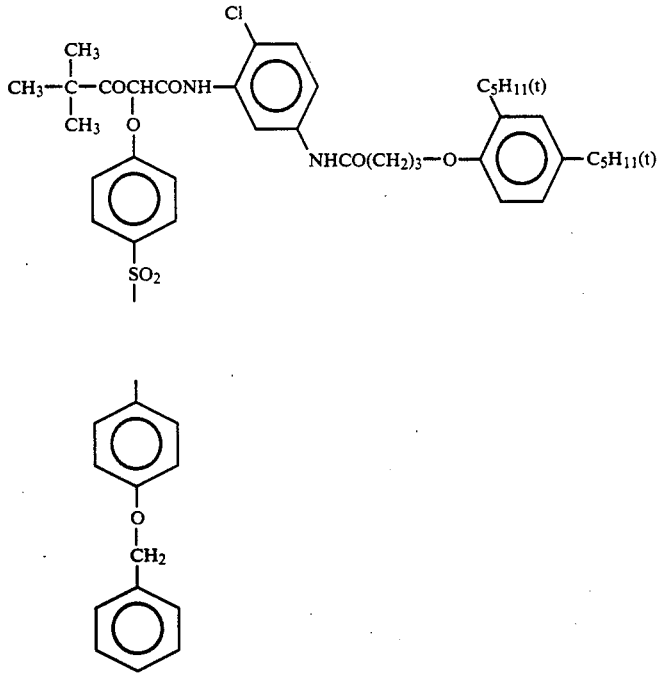
(Y-50)
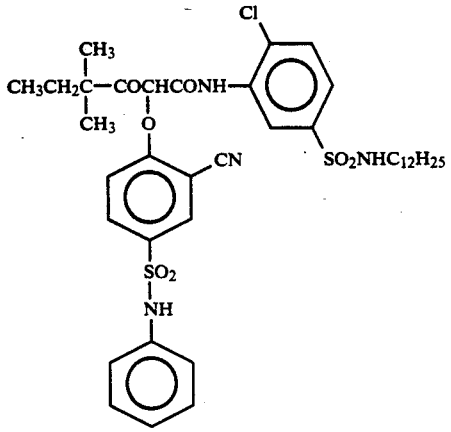

-continued
(Y-51)
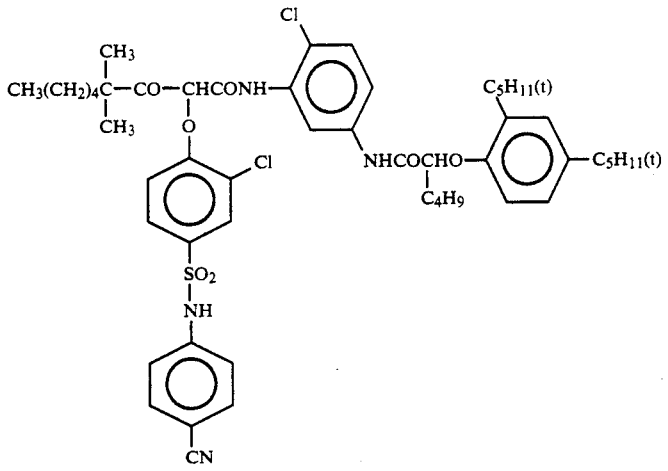
(Y-52)
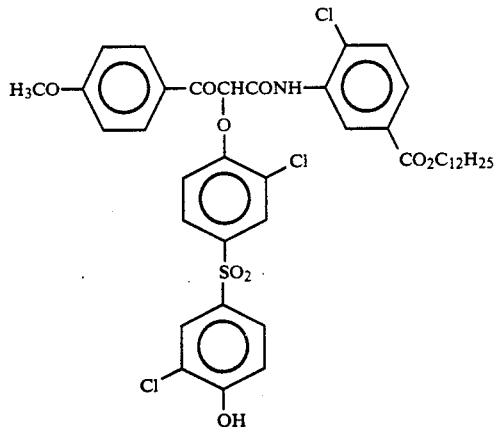
(Y-53)
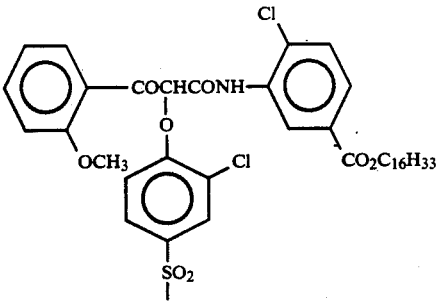
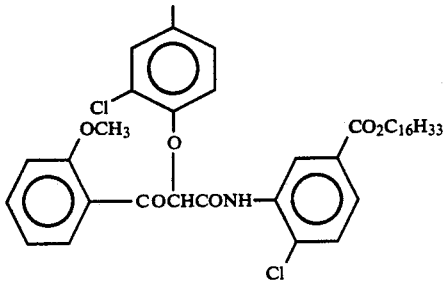

-continued
(Y-54)
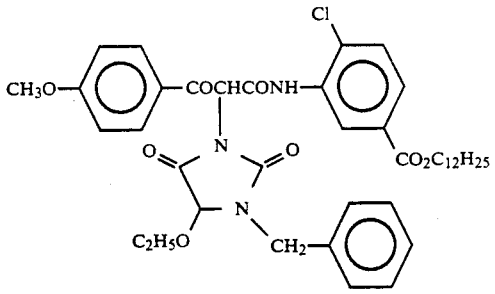
(Y-55)
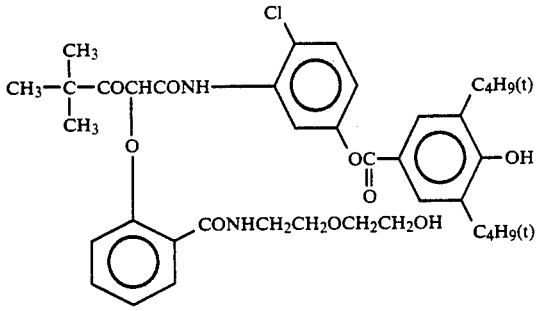
(Y-56)
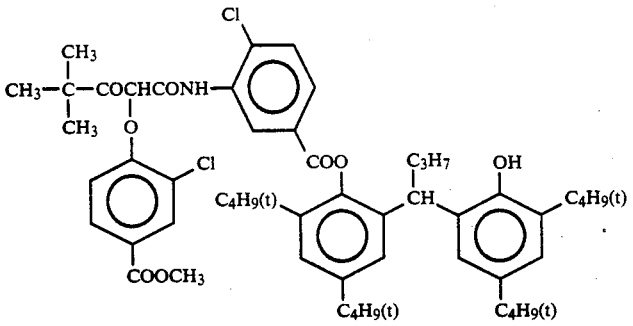
(Y-57)
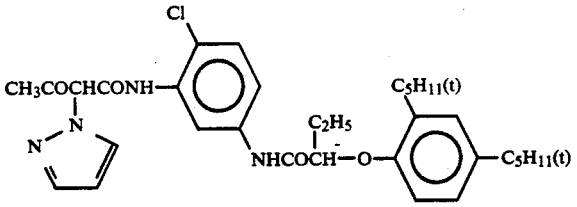
(Y-58)
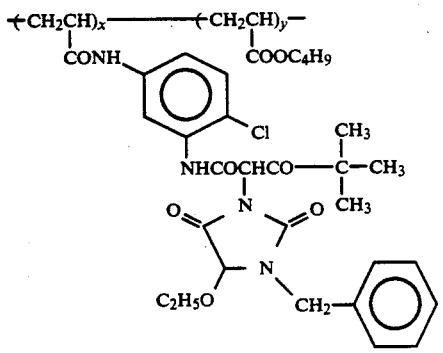
X/Y = 50/50 (as weight ratio)

-continued (Y-59)

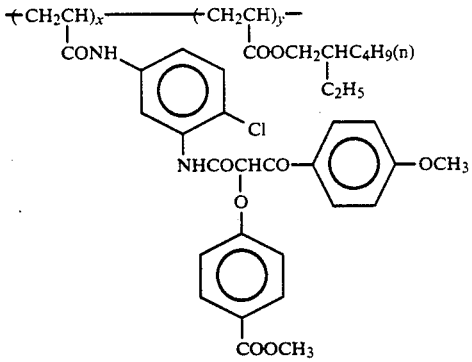

X/Y = 45/55 (as weight ratio)

(Y-60)

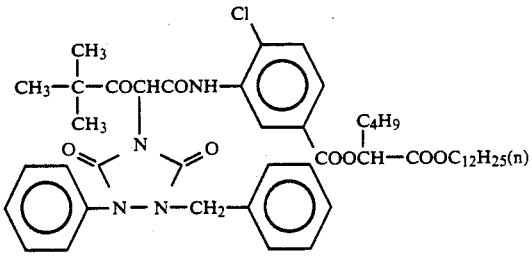

(Y-61)

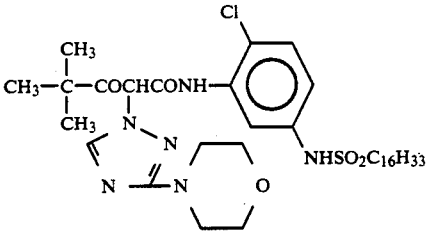

(Y-62)

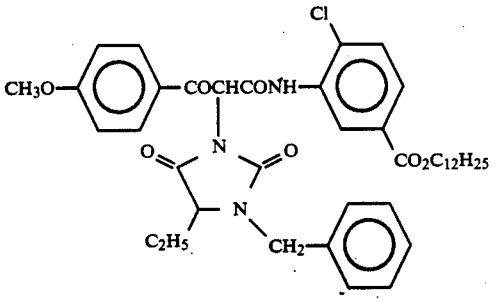

The synthesis of the above-mentioned yellow coupler is analogous to the method described in Japanese Patent Publications No. 51(1976)-10786, No. 51-(1976)-33410 and No. 52(1977)-25733, Japanese Patent Provisional Publications No. 47(1972)-26133, No. 48(1973)-73147, No. 51(1976)-102636, No. 50(1975)-130442, No. 50(1975)-6341, No. 50(1975)-123342, No. 51(1976)-21827, No. 50(1975)-87650, No. 52(1977)-82424 and No. 52(1987)-115219, British Patent No. 1425020, German Patent No. 1547868, German Patent Provisional Publications No. 2219917, No. 2261361 and No. 2414006, European Patents No. 272041 and No. 249473, and Japanese Patent Provisional Publication No. 63(1988)-43144.

The yellow coupler used in the present invention can be synthesized, for example, according to the following synthesis example.

SYNTHESIS EXAMPLE 1

Synthesis of Yellow Coupler (Y-5)

In 240 ml of dimethylacetamide and 210 ml of acetonitrile were dissolved 44 g of α-chloro-α-pivaloyl-2-chloro-5-(n-hexadecanesulfonamido)acetoanilide and 112 g of 3,3'-dichloro-4,4'-dihydroxydiphenylsulfone under reflux.

To the solution was dropwise added 9.7 ml of triethylamine, and the reaction proceeded for 5 hours under reflux.

The reaction mixture was poured into 500 ml of sodium hydroxide, and extracted with 300 ml of ethyl acetate.

The oily phase was twice washed with water, dried on magnesium sulfate, and concentrated under reduced pressure to obtain a residue.

The residue was chromatographed over silica gel, and the fraction containing a reaction product was concentrated under reduced pressure. The residue was crystallized in n-hexane/ethanol (10/1 as volume ratio) to obtain 45 g of the above-mentioned coupler (Y-5). The melting point was 91° to 93° C.

According to the present invention, a yellow coupler is used in an amount of $2\times10^{-3}$ mole to $5\times10^{-1}$ mole based on 1 mole of silver contained in an emulsion layer, and preferably in an amount of $1\times10^{-2}$ mole to $5\times10^{-1}$ mole.

The above-mentioned yellow couplers can be used singly or in combination of two or more compounds.

The organic compound having the formula [I] or [II] is hereinafter described in more detail.

The compound having the formula [I] or [II] used in the present invention is neither a reducing agent nor a coupler. The chemical structure of this compound is not changed in a color development process, while the structure of the reducing agent is changed in the development process. Further, this compound is substantially not decomposed in the color development process.

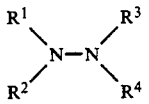
[I]

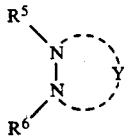
[II]

In the formula [I], each of $R^1$, $R^2$, $R^3$ and $R^4$ independently is hydrogen, an alkyl group (e.g., methyl, tert-butyl, octyl, cyclohexyl, hexadecyl and ethoxyethyl), an alkenyl group (e.g., vinyl and allyl), an aryl group (e.g., phenyl, 2,4,6-trichlorophenyl and m-hexadecyloxyphenyl), a heterocyclic group (e.g., pyridyl and pyrazolyl), an alkoxycarbonyl group (e.g., methoxycarbonyl, 2-ethylhexyloxycarbonyl and hexadecylcarbonyl), an aryloxycarbonyl group (e.g., phenyloxycarbonyl and p-tert-butylphenyloxycarbonyl), an acyl group (acetyl, tetradecanoyl, 2,4-di-tert-amylphenoxyacetyl, α-2,4-di-tert-amylphenoxybutylyl, benzoyl and p-tert-butylbenzoyl), a sulfonyl group (e.g., methanesulfonyl, octanesulfonyl, benzenesulfonyl, 4-(4-tert-octylphenoxy)-butanesulfonyl and 4-ethoxybenzenesulfonyl), a sulfinyl group (e.g., butylsulfinyl, octylsulfinyl and benzenesulfinyl), a phosphoryl group (e.g., diethylphosphoryl and diphenylphosphoryl), a carbamoyl group (e.g., dimethylcarbamoyl and diethylcarbamoyl) or a sulfamoyl group (e.g., diethylsulfamoyl and dioctylsulfamoyl). $R^1$ and $R^2$, or $R^3$ and $R^4$ may form, together with the nitrogen atom, a 5- to 8-membered heterocyclic ring (e.g., ring having piperidine nucleus, morpholine nucleus or pyrazolidine nucleus). Neither $R^1$ and $R^2$ nor $R^3$ and $R^4$ form a heterocyclic ring which consists of the nitrogen atom, an alkylene group, sulfonyl or sulfinyl and an alkylene group in the order. When one of $R^1$ and $R^2$ is hydrogen, the other is not an arylsulfonyl group. When one of $R^3$ and $R^4$ is hydrogen, the other is not an arylsulfonyl group. Two or more compounds having the formula [I] may be combined with each other at the position of $R^1$, $R^2$, $R^3$ or $R^4$ to form a polymer. The number of the total carbon atoms contained in $R^1$, $R^2$, $R^3$ and $R^4$ is not less than 6, and preferably is 6 to 50. It is preferred that each of $R^1$, $R^2$, $R^3$ and $R^6$ independently contains not more than 40 carbon atoms. Each of $R^1$, $R^2$, $R^3$ and $R^4$ is neither a residue of a coupler nor a reducing agent.

It is preferred that one of $R^1$, $R^2$, $R^3$ and $R^4$ in the formula [I] is a group selected from the group consisting of an alkyl group, an aryl group and a heterocyclic group, the others are not hydrogen. It is also preferred that one of $R^1$ and $R^2$ is not hydrogen, and one of $R^3$ and $R^4$ is not hydrogen. It is further preferred that each of one of $R^1$ and $R^2$ and one of $R^3$ or $R^4$ independently is an alkoxycarbonyl group, an aryloxycarbonyl group, an acyl group, an alkylsulfonyl group, a sulfinyl group, a phosphoryl group, a carbamoyl group or a sulfamoyl group.

In the formula [II], each of $R^5$ and $R^6$ independently is a group selected from the group consisting of hydrogen, an alkyl group (e.g., methyl, butyl, tert-butyl, hexadecyl, phenoxyethyl and methoxyethyl), a cycloalkyl group (e.g., cyclopentyl and cyclohexyl), an alkenyl group (e.g., 2-propenyl and 1,3-butadienyl), a cycloalkenyl group (e.g., cyclohexenyl and cyclooctenyl), an aryl group (e.g., phenyl, naphthyl and methoxyphenyl), a heterocyclic group (e.g., furyl, oxazolyl and thiazolyl), an acyl group (e.g., acetyl, docecanoyl and benzoyl), a sulfonyl group (e.g., dodecylsulfonyl, hexadecylsulfonyl and benzenesulfonyl), a phosphoryl group (e.g., butyloctylphosphoryl, octyloxyphosphoryl and aryloxyphosphoryl), a sulfinyl group (e.g., octylsulfinyl, benzenesulfinyl), an alkylcarbamoyl group (e.g., N-methylcarbamoyl, N-dodecylcarbamoyl and N,N-dibutylcarbamoyl), an arylcarbamoyl group (e.g., N-phenyl-carbamoyl and N-p-methoxyphenylcarbamoyl), an alkylsulfamoyl group (e.g., N-methylsulfamoyl and N,N-diethylsulfamoyl), an arylsulfamoyl group (N-phenylsulfamoyl and N-p-methoxyphenylsulfamoyl), an alkoxycarbonyl group (e.g., methoxycarbonyl and dodecyloxycarbonyl) and an aryloxycarbonyl group (e.g., phenyloxycarbonyl and p-methoxyphenoxycarbonyl).

In the formula [II], Y is a non-metallic atomic group which forms, together with the two nitrogen atoms, a 5- to 8-membered heterocyclic ring (e.g., ring having pyrazolidine nucleus, pyrazoline nucleus or perhydropyridadine nucleus). The formed heterocyclic ring may have one or more substituent groups, such as an alkyl group, an alkoxycarbonyl group, an alkylcarbamoyl group, an alkylsulfamoyl group, an alkylureido group, an alkoxycarbonylamino group, an alkylsulfonyl group, an acyl group, a halogen atom, an aryl group, an aryloxy group, an aryloxycarbonyl group, an arylcarbamoyl group, an arylsulfamoyl group, an arylureido group, an aryloxycarbonyl amino group and an arylsulfonyl group. Y does not form a heterocyclic ring which consists of the nitrogen atom, an alkylene group, a hetero-atom, an alkylene group and the other nitrogen atom in the order. Further, Y does not form a perhydro-1,2,4,5-tetrazine ring. When Y forms 1-phenyl-3-pyrazolidone, neither hydrogen, acetyl nor an acyl group substituted with carboxyl is placed at the 2-position of 1-phenyl-3-pyrazolidone.

The number of the total carbon atoms contained in $R^5$ and $R^6$ is not less than 6, and preferably is 6 to 50. It is preferred that each of $R^5$ and $R^6$ independently contains not more than 40 carbon atoms.

It is preferred that one of $R^5$ and $R^6$ is not hydrogen. It is also preferred that Y contains a carbonyl group or a sulfonyl group which is attached to the nitrogen atom.

Examples of the compound having the formula [I] or [II] used in the present invention are described hereinafter without limiting the invention. The following formulas (A-1) to (A-32) are the examples of the compound having the formula [I]. The following formulas (a-1) to (a-47) are the examples of the compound having the formula [II].

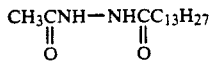
(A-1)

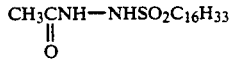
(A-2)

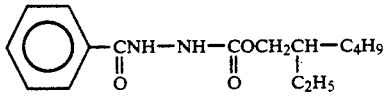
(A-3)

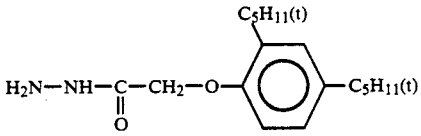
(A-4)

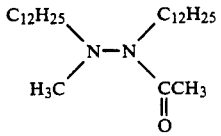
(A-5)

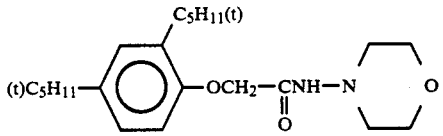
(A-6)

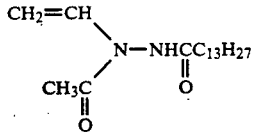
(A-7)

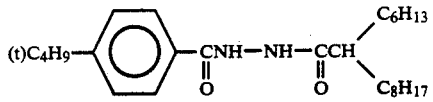
(A-8)

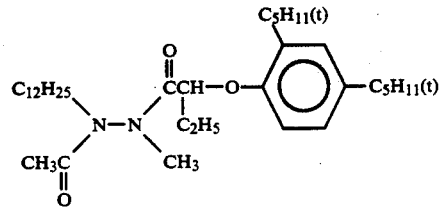
(A-9)

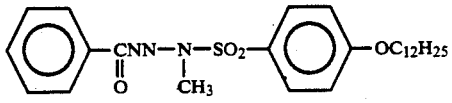
(A-10)

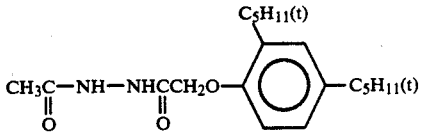
(A-11)

-continued
(A-12)
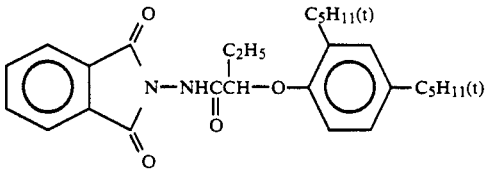
(A-13)
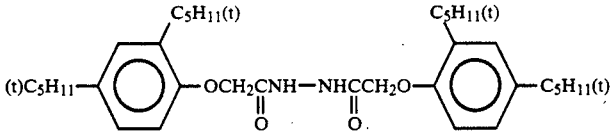
(A-14)
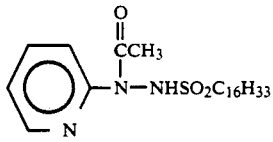
(A-15)
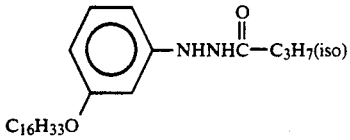
(A-16)
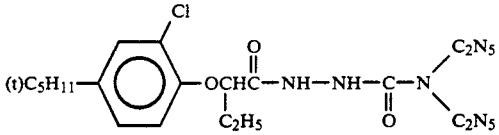
(A-17)
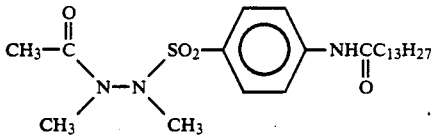
(A-18)
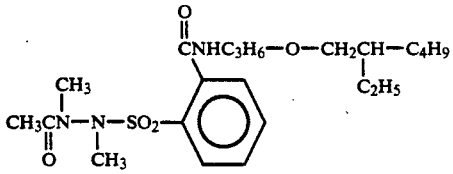
(A-19)
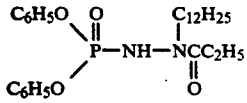
(A-20)
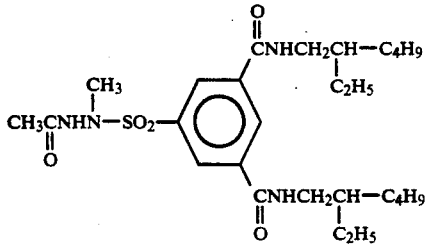
(A-21)
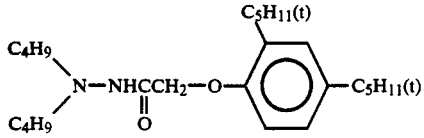

-continued
(A-22)
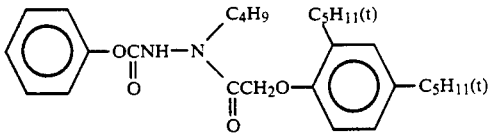
(A-23)
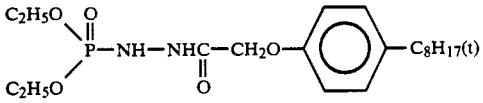
(A-24)
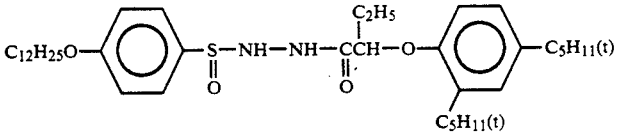
(A-25)
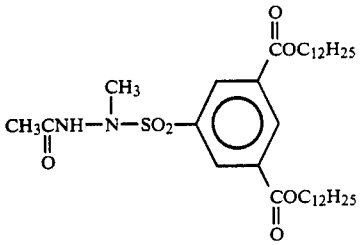
(A-26)
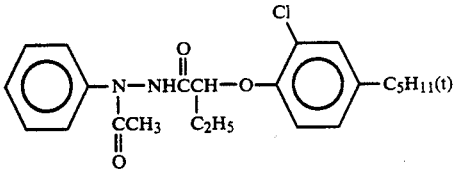
(A-27)
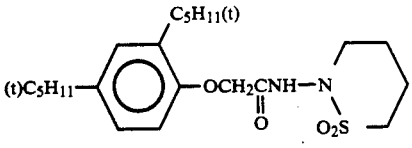
(A-28)
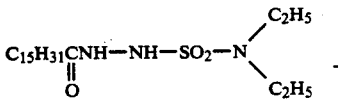
(A-29)
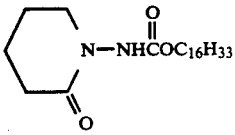
(A-30)
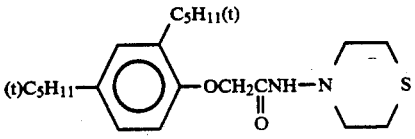
(A-31)
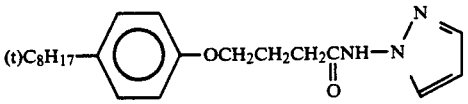

-continued
(A-32)
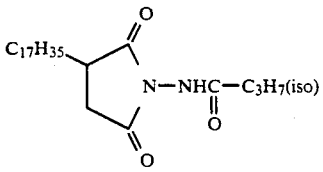
(a-1)
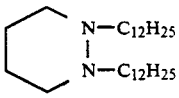
(a-2)
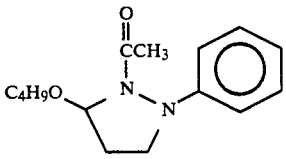
(a-3)
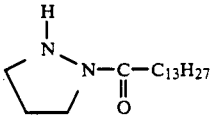
(a-4)
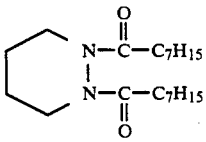
(a-5)
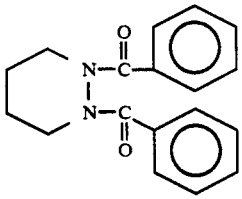
(a-6)
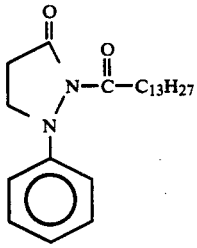
(a-7)
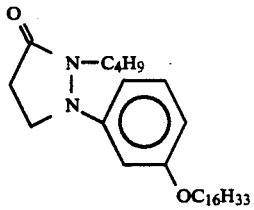
(a-8)
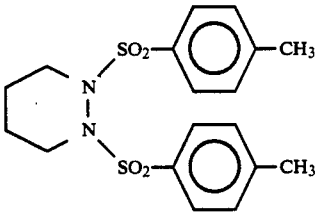

-continued
(a-9)
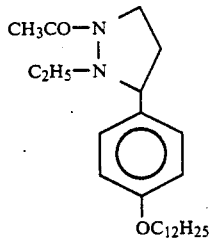
(a-10)
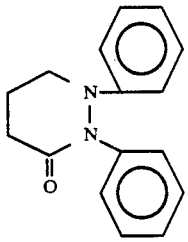
(a-11)
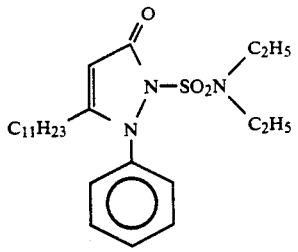
(a-12)
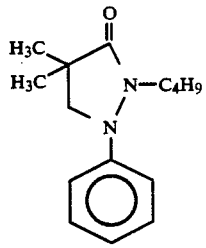
(a-13)
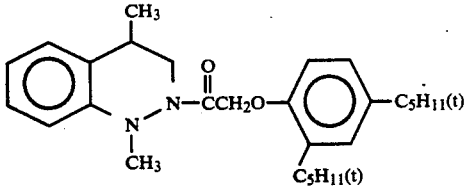
(a-14)
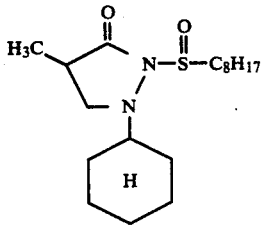

-continued
(a-15)
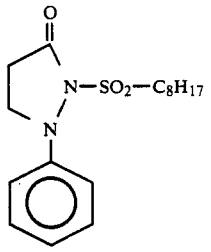
(a-16)
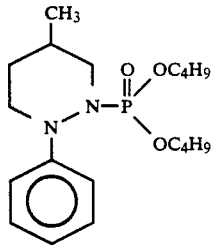
(a-17)
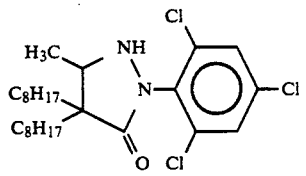
(a-18)
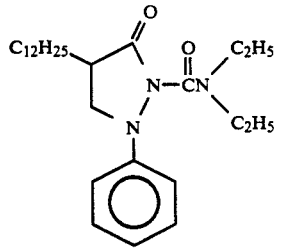
(a-19)
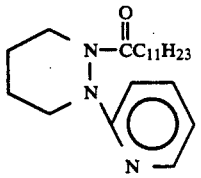
(a-20)
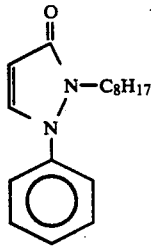
(a-21)
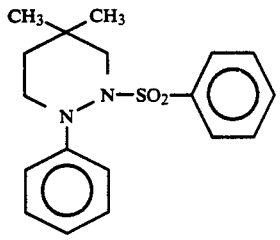

-continued
(a-22)
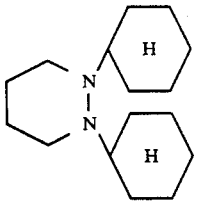
(a-23)
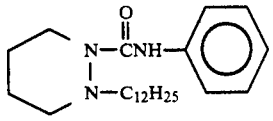
(a-24)
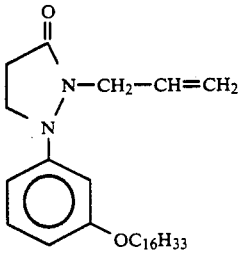
(a-25)
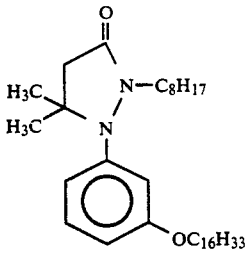
(a-26)
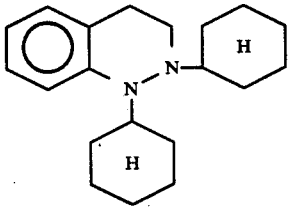
(a-27)
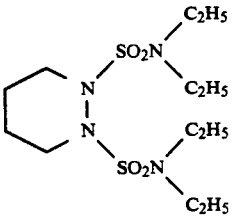
(a-28)
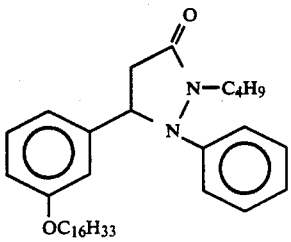

-continued
(a-29)
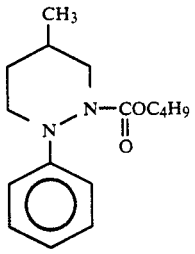
(a-30)
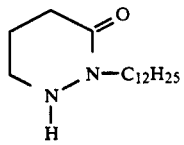
(a-31)
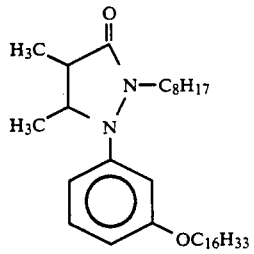
(a-32)
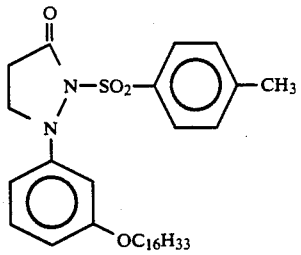
(a-33)
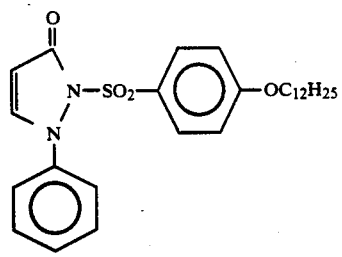
(a-34)
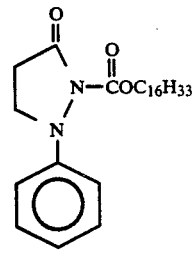
(a-35)
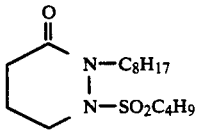

-continued
(a-36)
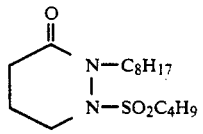
(a-37)
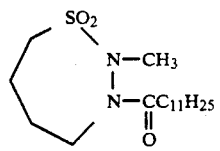
(a-38)
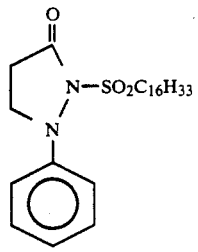
(a-39)
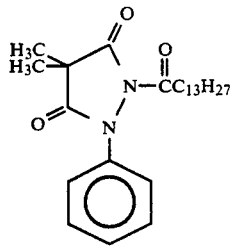
(a-40)
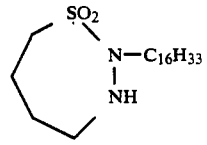
(a-41)
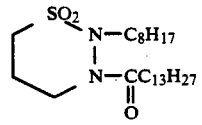
(a-42)
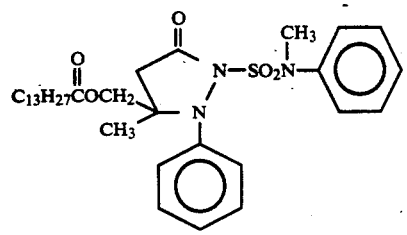
(a-43)
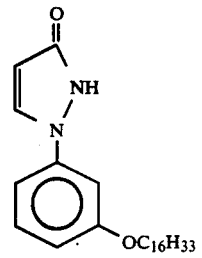

-continued (a-44)

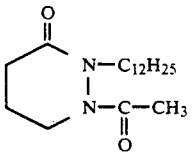

(a-45)

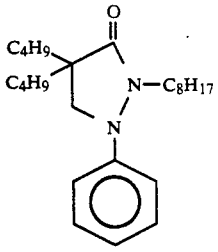

(a-46)

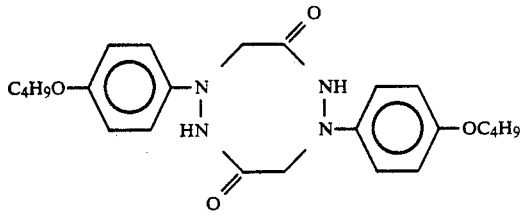

(a-47)

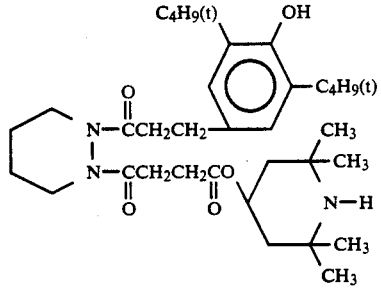

The compound having the formula [I] can be synthesized by a method or its analogous method described in J. Am. Chem. Soc., 72, 2762 (1950), Org. Synth., II, 395 (1943), Shin Jikken Kagaku Koza (written in Japanese) vol. 14-3, 1573 (1978), Japanese Patent Provisional Publications No. 62(1987)-270954 and No. 63(1988)-43145 and European Patent No. 255,722.

The compound having the formula [II] can be synthesized by a method or its analogous method described in Japanese Patent Provisional Publications No. 63(1988)-95444 and No. 63(1988)-115866, Helv. Chem. Acta., vol. 36, pp. 75 (1953) and Shin Jikken Kagaku Koza (written in Japanese, Maruzen Co., Ltd.) vol. 14, 1220 (1977).

The compound having the formula [I] used in the present invention can be synthesized, for example, according to the following synthesis example.

SYNTHESIS EXAMPLE 2

Synthesis of Compound (A-4)

To 15 ml of hydrazine hydrate was added 60 ml of dimethylacetamide. To the mixture was dropwise added 31.0 g of 2,4-di-tert-amylphenoxyacetylchloride while stirring at 10° to 15° C. The mixture was further stirred at 20° to 25° C. for 1 hour. The reaction mixture was poured into 200 ml of ice-cold water, and extracted with 200 ml of ethyl acetate. The oily phase was twice washed with water, dried on salt cake, and concentrated under reduced pressure. The residue was crystallized in 150 ml of methanol. The crystal was filtered off, and purified by column chromatography to obtain 25 g of the above-mentioned compound (A-4) as an oily substance.

Synthesis of Compound (A-13)

To 15.3 g of the compound (A.4) were added 30 ml of dimethylacetamide, 30 ml of acetonitrile and 8 ml of triethylamine.To the mixture was dropwise added 15.0 g of 2,4-di-tert-amylphenoxyacetylchloride while stirring at 10° to 15° C. The mixture was further stirred at 20° to 25 ° C. for 30 minutes. The reaction mixture was poured into 200 ml of ice-cold water, and extracted with 200 ml of ethyl acetate. The oily phase was twice washed with water, dried on salt cake, and concentrated under reduced pressure. The residue was crystallized in 200 ml of methanol. The crystal was filtered off, and washed with cold methanol to obtain 18.5 g of the above-mentioned compound (A-13). The melting point was 122° to 124° C.

Some of the compounds having the formula [I] are described in Japanese Patent Provisional Publications No. 62(1987)-270954 and No. 63(1988)-43145 as a color image stabilizer for a magenta coupler. Some of the compounds having the formula [II] are also described in Japanese Patent Provisional Publications No. 63(1988)-43145 and No. 63(1988)-115866 and Japanese Patent Publication No. 60(1985)-47573 as a color image stabilizer for a magenta coupler. But, the color image stabilizers for a magenta coupler do not always have any effect on a yellow coupler.

The present inventors have found that the compound having the formula [I] or [II] shows a remarkable effect on the dye image formed by a yellow coupler. The effect is to improve the stability of the yellow image to heat or light without a bad effect on the quality of the photograph.

The amount of the compound [I] or [II] is depend on the nature of the coupler used in combination. The amount is in the range of 5 to 400 mole % based on 1 mole of the coupler, and preferably in the range of 10 to 200 mole %. If the amount is smaller than this range, the effect is too small for practical use. If the amount is larger than the range, the color density may be decreased by an inhibition of a development reaction.

The compounds having the formula [I] or [II] can be used singly or in combination of two or more compounds. Further, the compounds may be used in combination with known color image stabilizers.

Examples of the known color image stabilizers include phenols, hindered amines, phosphate esters, hydrazines and complexes. These known color image stabilizers are described in Japanese Patent Provisional Publications No. 58(1983)-14036, No. 59(1984)-5426 and No. 61(1986)-2151, Japanese Patent Publications No. 62(1987)-28182, No. 48(1973-31256, No. 51(1976)-1420 and No. 52(1977)-6623, British Patents No. 1,326,889, No. 1,354,313 and No. 1,410,846, U.S. Pat. Nos. 3,335,135 and No. 4,268,593, and European Patents No. 246,766 and No. 265,196.

According to the present invention, the compound having the formula [I] or [II] is used in the layer containing a yellow coupler in such manner that the compound and the yellow coupler are together contained in droplets of a medium which are dispersed in the layer. The medium preferably is an organic solvent having a high boiling point.

The color photosensitive material of the present invention preferably comprises a blue sensitive silver halide emulsion layer, a green sensitive silver halide emulsion layer and a read sensitive silver halide emulsion layer on a support in the order. This order may be changed.

Examples of the silver halide used in the present invention include silver chloride, silver bromide, silver iodide, silver chloro(iodo)bromide and silver iodobromide. Silver chloride and silver chloro(iodo)bromide are particularly preferred. With respect to the halogen composition, the silver halide grains contained in an emulsion layer preferably are silver chlorobromide which substantially does not contain silver iodide and contains silver chloride in an amount of not less than 90 moles % based on the total amount of the silver halide. The term "substantially does not contain silver iodide" means that the iodide content is not more than 1.0 mole %. It is more preferred that the silver halide grains contained in an emulsion layer preferably are silver chlorobromide which substantially does not contain silver iodide and contains silver chloride in an amount of not less than 95 mole % based on the total amount of the silver halide.

The silver halide grains preferably have a phase where silver bromide is localized in an amount of 10 mole % to 70 mole %. The silver bromide localized phase may be arranged in the inside, surface or subsurface of the silver halide grains. The localized phase may be also divided into the inside, surface or subsurface. Further, the localized phase may have a layered structure surrounding the silver halide grain or have a discontinuous structure in the inside or surface of the grain. A preferred example of the arrangement of the silver bromide localized phase is that the localized phase containing silver bromide in an amount of not less than 10 mole % (more preferably not less than 20 mole %) is epitaxially formed in the surface of (particularly an edge of) the silver halide grain.

It is more preferred that the localized phase contains silver bromide in an amount of not less than 20 mole %. If the content of silver bromide is relatively high, the localized phase sometimes affects the quality of the photosensitive material. In more detail, if the silver bromide content is high, the sensitivity of the photosensitive material tends to be lowered when pressure is applied to the material, and the sensitivity or gradation of the photosensitive material may be markedly changed according to the change of the composition of a processing solution. Accordingly, the silver bromide content in the localized phase more preferably is in the range of 20 to 60 mole %, and most preferably in in the range of 30 to 60 mole %. The silver halide other than the localized phase preferably is silver chloride. The silver bromide content in the localized phase can be analyzed by X-ray analysis or XPS (X-ray photoelectron spectroscopy). The localized phase preferably has a silver content in the range of 0.1 to 20% (more preferably 0.5 to 7 %) based on the total silver content.

The interface between the silver bromide localized phase and the other phase may be either a clear boundary or a transition area where the halogen composition is gradually changed. The position of the the silver bromide localized phase can be observed by an electron microscope or a method described in European Patent Provisional Publication No. 273430A2.

The above-mentioned silver bromide localized phase can be formed by various methods. For example, the localized phase can be formed by a reaction of a soluble silver salt with a soluble halogen salt in a single jet process or a double jet process. The localized phase can also be formed by a conversion method which includes a process of converting the formed silver halide into another silver halide having a smaller solubility product. Further, the localized phase can be formed by recrystallization of silver bromide micrograins on the surface of silver chloride grains. These methods are described in various publications, such as European Patent Provisional Publication No. 273430A2.

In the present invention, a metal ion other than silver ion (e.g., the metal ions of the VIII group in periodic table, the transition metal ions of the II group, lead ion and thallium ion) is preferably added to the localized phase or the base of the phase (i.e., the portion other than the localized phase) in the silver halide grain to improve the effect of the invention.

Iridium ion, rhodium ion or iron ion is preferably added to the localized phase. Osmium ion, iridium ion, rhodium ion, platinum ion, ruthenium ion, palladium ion, cobalt ion, nickel ion, iron ion or a complex ion thereof is preferably added to the base of the phase. The phase may be different from the base in the nature and amount of the metal ion The metal ion can be contained in the localized phase and/or the base in the silver halide grain by adding the metal ion into a silver halide emulsion in preparation before or after the grain formation or at the stage of physical ripening. For example, the metal ion can be added to a gelatin solution, a halogen salt solution, a silver salt solution or the other solutions to form silver halide grains.

Further, the metal ion can be introduced into the silver halide grain by adding silver halide micrograins which contain a metal ion to a silver halide emulsion, and dissolving the silver halide micrograins. This method is advantageous to the preparation of the silver halide grain in which the silver bromide localized phase is arranged on the surface of the grain. The method of adding the metal ion can be selected depending on the position where the metal ion is localized.

At least 50% of iridium ion based on the total amount of the ion contained in the silver halide grain is preferably deposited together with the localized phase.

The iridium ion can be deposited together with the localized phase by adding an iridium compound either before, simultaneously with or after the addition of silver and/or halogen.

The silver halide grain used in the present invention preferably has a hundred and/or a hundred and eleven sides on the surface. The grain may have sides of a higher order.

The shape of the silver halide grain may be either in the form of a regular crystal (e.g., cube, tetradecahedron and octahedron) or in the form of an irregular crystal (e.g., globular and tabular shapes). Further, the shape of the grain may be complex of two or more crystals. Two or more silver halide grains differing in the shape can be employed. At least 50% of the silver halide grains preferably (more preferably at least 70%, and most preferably at least 90%) are in the form of a regular crystal. A tabular silver halide grain having an aspect ratio (length/thickness) of not less than 5 (more preferably not less than 8) can be also employed in an amount of at least 50% based on the total projected area of the silver halide grains.

The silver halide grains used in the present invention have a mean grain size in the conventional range, and preferably in the range of 0.1 to 1.5 μm. There is no specific limitation on the grain size distribution of silver halide grains. Silver halide grains having an almost uniform grain size distribution are preferably employed. In more detail, the silver halide grains preferably have such a grain size distribution that the coefficient of variation (S/d) is not more than 20%, wherein "S" means a standard deviation of the grain size as a circular approximation of the projected area and "d" means the average grain size. The coefficient of the variation more preferably is not more than 15%.

A mixture of a silver halide emulsion containing tabular silver halide grains and an emulsion having an almost uniform grain size distribution can be employed. The latter emulsion preferably has the above-defined coefficient of the variation. It is more preferred that the mixture also has the coefficient of the variation.

The portion other than the localized phase (i.e., the base) may be either heterogeneous from the inside to the surface of the grain or homogeneous.

The silver halide emulsion used in the present invention is usually physically and chemically ripened and spectrally sensitized. Preferred examples of the chemical sensitizer used for the chemical ripening are described at pages 18 to 22 in Japanese Patent Provisional Publication No. 62(1987)-215272. Preferred examples of the spectral sensitizer are described at pages 22 to 38 in Japanese Patent Provisional Publication No. 62(1987)-215272.

Further, preferred examples of the antifogging agent and the stabilizer which are used in the preparation or preservation of the silver halide emulsion are described at pages 39 to 72 in Japanese Patent Provisional Publication No. 62(1987)-215272.

Examples of the magenta coupler used in the present invention include oil protected couplers, such as indazolone couplers, cyanoacetyl couplers 5-pyrazolone couplers and pyrazoloazole couplers. The 5.pyrazolone couplers and the pyrazoloazole couplers (e.g., pyrazolotriazoles) are preferred. The 5-pyrazolone couplers are preferably substituted with an arylamino group or an acylamino group at 3-position from the viewpoint of the hue of the developed dye and the density of the color. Examples of the substituted 5.pyrazolone couplers are described in U.S. Pat. No. 2,311,082, No. 2,343,703, No. 2,600,788, No. 2,908,573, No. 3,062,653, No. 3,152,896 and No. 3,936,015. The elimination group of two equivalent 5-pyrazolone coupler preferably is the nitrogen eliminating group described in U.S. Pat. No. 4,351,987 or an arylthio group described in International Provisional Publication No. WO-88-04795. The 5-pyrazolone coupler having a ballast group described in European Patent No. 73,636 gives a high color density.

Preferred examples of the pyrazoloazole couplers include pyrazolo[5,1-c][1,2,4]triazoles described in U.S. Pat. No. 3,725,067, pyrazolotetrazoles described in Research Disclosure 24220 (Jun., 1984) and pyrazolopyrazoles described in Research Disclosure 24230 (Jun., 1984). The above-mentioned couplers may be in the form of a polymer coupler.

In more detail, the magenta couplers preferably are the compounds having the following formula [M-I], [M-II] or [M-III].

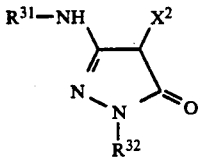
[M-I]

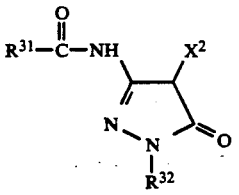
[M-II]

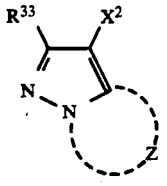
[M-III]

in which $R^{31}$ is a ballast group containing 8–32 carbon atoms; $R^{32}$ is phenyl or a substituted phenyl group; $R^{33}$ is hydrogen or another substituent group; Z is a non-metallic atomic group which form a 5-membered azole ring containing 2, 3 or 4 nitrogen atoms; the azole ring may have one or more substituent groups; $X^2$ is hydrogen or an elimination group.

Examples of the substituent groups represented by $R^{33}$ and the substituent groups attached to the azole ring are described at column 2, line 41 to column 8, line 27 in U.S. Pat. No. 4,540,654.

It is preferred that the unwanted absorption of the magenta coupler within the yellow range is small and the formed dye is stable to light. From these view points, imidazo[1,2-b]pyrazoles described in U.S. Pat. No. 4,500,630 are preferred, and pyrazolo[1,5-b][1,2,4]triazoles described in U.S. Pat. No. 4,540,654 are particularly preferred.

The other available magenta couplers includes pyrazolotriazole couplers in which a branched alkyl group is attached to the pyrazolotriazole ring at 2-, 3- or 6-position (cf., Japanese Patent Provisional Publication No. 61(1986)-65245); pyrazoloazole couplers containing sulfonamido group in its molecule (cf., Japanese Patent Provisional Publication No. 61(1986)-65246); pyrazoloazole couplers having an alkoxyphenylsulfonamido group as a ballast group (cf., Japanese Patent Provisional Publication No. 61(1986)-147254); and pyrazolotriazole couplers having an alkoxy group or an aryloxy group at 6-position (cf., European Patent Provisional Publication No. 226,849).

Examples of the magenta couplers are described hereinafter.

| (Compound) ($R^{33}$—) | ($-R^{34}$) | ($-X^2$) |
|---|---|---|
| | 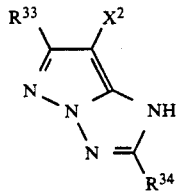 | |
| (M-1) $CH_3$— | 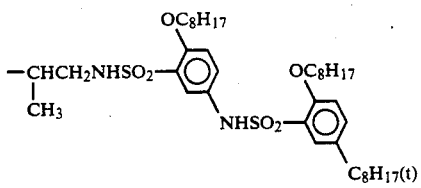 | —Cl |
| (M-2) $CH_3$— | 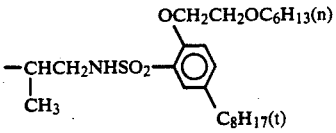 | —Cl |
| (M-3) $CH_3$— | 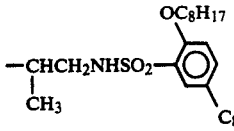 | 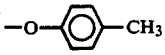 |
| (M-4) 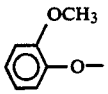 | 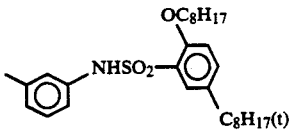 | 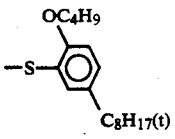 |
| (M-5) $CH_3$— | 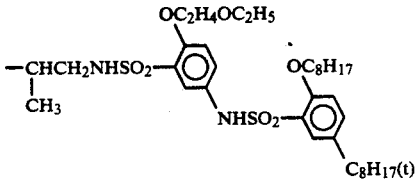 | —Cl |
| (M-6) | | |

-continued
| (Compound) ($R^{33}$—) | ($-R^{34}$) | ($-X^2$) |
|---|---|---|
| $CH_3$— | 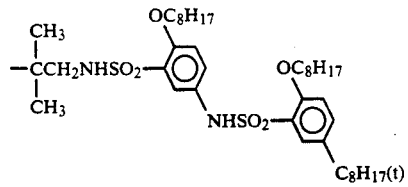 | —Cl |
| (M-7) 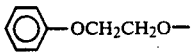 | 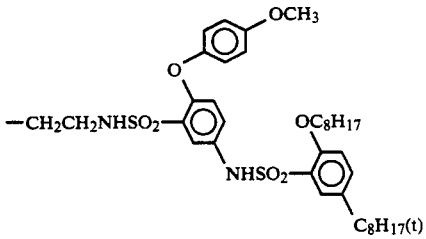 | 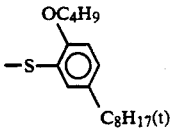 |
| (M-8) $CH_3CH_2O$— | 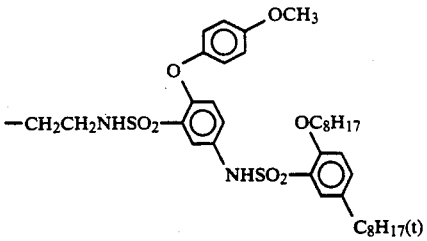 | 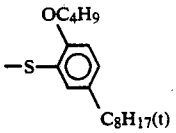 |
| (M-9) 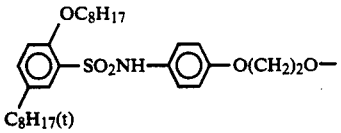 | 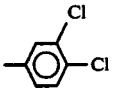 | 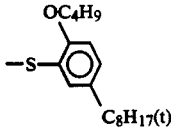 |
| (M-10) 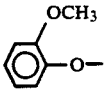 | 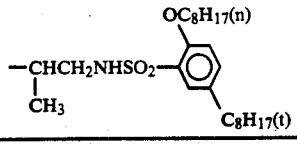 | —Cl |
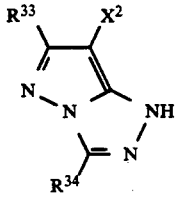
| | | |
|---|---|---|
| (M-11) $CH_3$— | 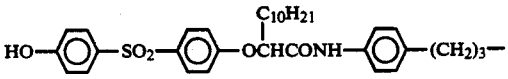 | —Cl |
| (M-12) $CH_3$— | 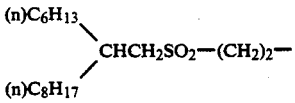 | —Cl |
| (M-13) | | |

-continued

| (Compound) ($R^{33}$—) | (—$R^{34}$) | (—$X^2$) |
|---|---|---|
| $CH_3$ \ CH— / $CH_3$ | $OC_8H_{17}$ / $SO_2$—$(CH_2)_3$— / $C_8H_{17}(t)$ | —Cl |
| (M-14) $\leftarrow CH—CH_2\rightarrow_{50}\leftarrow CH_2—C(CH_3)\rightarrow_{50}$ ; $COOCH_2CH_2OCH_3$ ; $CONH$— | $CH_3$—CH— / $CHNHSO_2CH_3$ | —Cl |
| (M-15) —O— | $OC_8H_{17}$ / $\leftarrow CH_2\rightarrow_2NHSO_2$— / $C_8H_{17}(t)$ | —Cl |
| (M-16) Cl / —O— | $OC_8H_{17}$ / $\leftarrow CH_2\rightarrow_2NHSO_2$— / $C_8H_{17}(t)$ | $OC_4H_9$ / —S— / $C_8H_{17}(t)$ |

Typical examples of cyan coupler are phenol cyan couplers and naphthol cyan couplers.

The phenol cyan couplers include compounds having an acylamino group at 2-position of phenol nucleus and an alkyl group at 5-position, which are described in U.S. Pat. No. 2,369,929, No. 4,518,687, No. 4,511,647 and No. 3,772,002. Examples of these compounds are the coupler using in Example 2 of Canadian Patent No. 625,822, the compound (1) described in U.S. Pat. No. 3,772,002, the compounds (I-4) and (I-5) described in U.S. Pat. No. 4,564,590, the compounds (1), (2), (3) and (24) described in Japanese Patent Provisional Publication No. 61(1986) 39045, and the compound (C-2) described in Japanese Patent Provisional Publication No. 62(1987)-70846.

The phenol cyan couplers also include 2,5-diacylaminophenol couplers, which are described in U.S. Pat. No. 2,772,162, No. 2,895,826, No. 4,334,011 and No. 4,500,635, and Japanese Patent Provisional Publication No. 59(1984)-164555. Examples of these compounds are the compound (V) described in U.S. Pat. No. 2,895,826, the compound (17) described in U.S. Pat. No. 4,557,999, the compounds (2) and (12) described in U.S. Pat. No. 4,565,777, the compound (4) described in U.S. Pat. No. 4,124,396, and the compound (I-19) described in U.S. Pat. No. 4,613,564.

The phenol cyan couplers further include compounds in which a nitrogen-containing heterocyclic ring is condensed with phenol nucleus, which are described in U.S. Pat. Nos. 4,372,173, 4,564,586 and 4,430,423, Japanese Patent Provisional Publication No. 61(1981)-390441, and Japanese Patent Application No. 61(1981)-100222. Examples of these compounds are the couplers (1) and (3) described in U.S. Pat. No. 4,327,173, the compounds (3) and (16) described in U.S. Pat. No. 4,564,586, the compounds (1) and (3) described in U.S. Pat. No. 4,430,423, and the compounds having the following formulas.

(C-1)

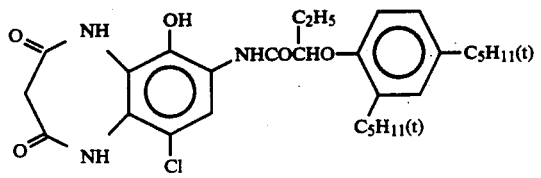

(C-2)

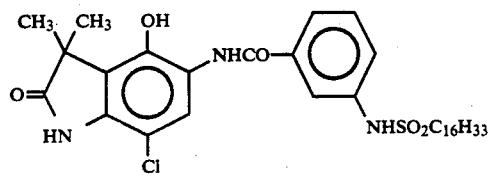

-continued
(C-3)
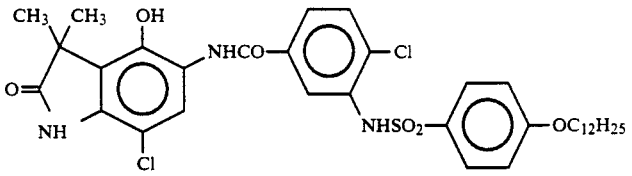
(C-4)
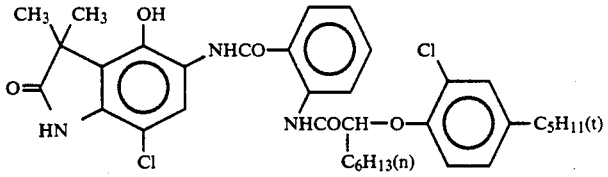
(C-5)
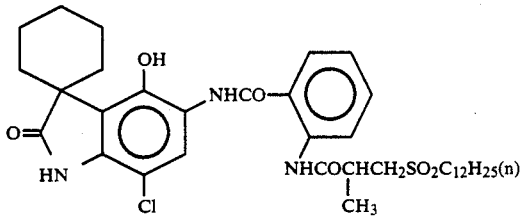
(C-6)
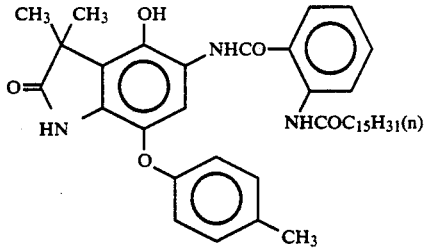
(C-7)
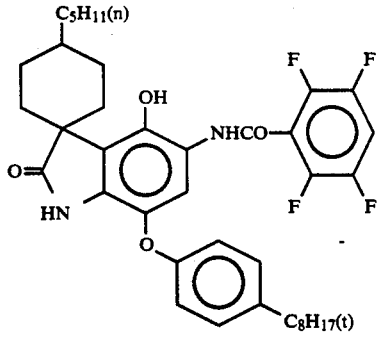
(C-8)
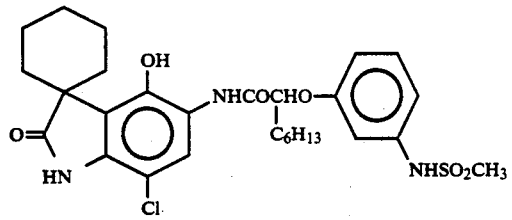
In addition to the above-mentioned cyan couplers, diphenylimidazole cyan couplers described in European Patent Provisional Publication No. 0,249,453A2 are also available.

(C-9)

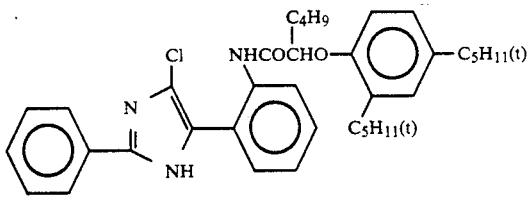

(C-10)

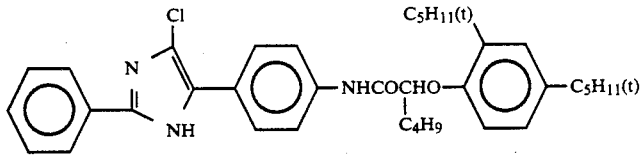

(C-11)

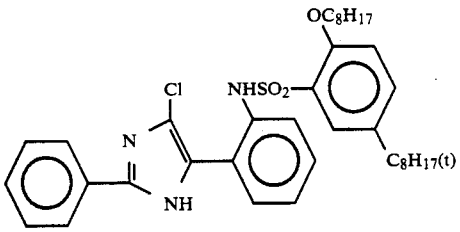

(C-12)

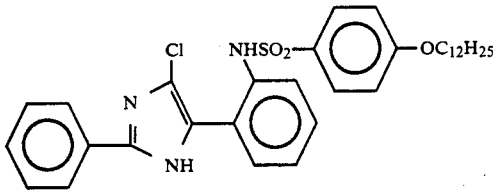

(C-13)

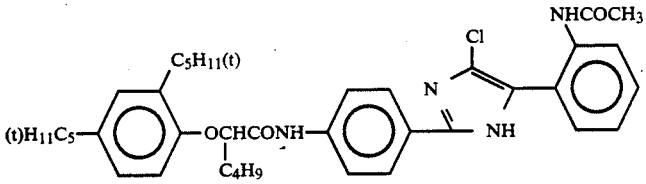

(C-14)

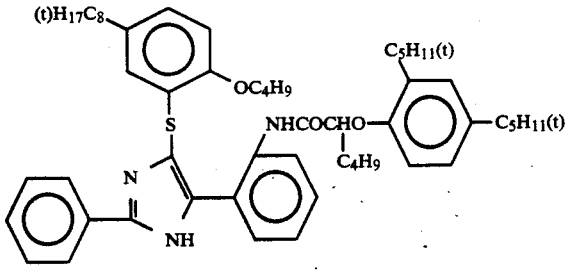

The phenol cyan couplers furthermore include ureido couplers, which are described in U.S. Pat. Nos. 4,333,999, 4,451,559, 4,444,872, 4,427,767 and 4,579,813, and European Patent No. 067,689B1. Examples of these compounds are the coupler (7) described in U.S. Pat. No. 4,333,999, the coupler (1) described in U.S. Pat. No. 4,451,559, the coupler (14) described in U.S. Pat. No. 4,444,872, the coupler (3) described in U.S. Pat. No. 4,427,767, the couplers (6) and (24) described in U.S. Pat. No. 4,609,619, the couplers (1) and (11) described in U.S. Pat. No. 4,579,813, the couplers (45) and (50) described in European Patent No. 067,689B1, and the coupler (3) described in Japanese Patent Provisional Publication No. 61(1986)-42658.

The naphthol cyan couplers include compounds having an N-alkyl-N-arylcarbamoyl group at 2-position of naphthol nucleus (cf., U.S. Pat. No. 2,313,586); compounds having an alkylcarbamoyl group at 2-position (cf., U.S. Pat. No. 2,474,293 and No. 4,282,312); compounds having an arylcarbamoyl group at 2-position (cf., Japanese Patent Publication No. 50(1975)-14523); compounds having a carboamido or sulfoamido group at 5-position (cf., Japanese Patent Provisional Publications No. 60(1985)-237448, No. 61(1986)-145557 and No. 61(1986)-153640); compounds having an aryloxy elimination group (cf., U.S. Pat. No. 3,476,563); compounds having a substituted alkoxy elimination group (cf., U.S. Pat. No. 3,476,563); and compounds having a group which eliminate glycolic acid (cf., Japanese Patent Publication No. 60(1985)-39217).

The above-mentioned yellow, magenta and cyan couplers can be dissolved in an organic medium having a high boiling point. The solution of the couplers are dispersed in the emulsion layer. The organic solvent preferably is a compound having the following formula (A), (B), (C), (D) or (E).

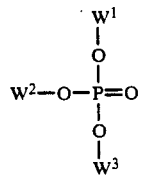
(A)

$W^1-COO-W^2$ (B)

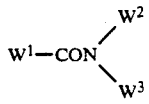
(C)

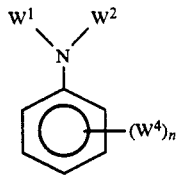
(D)

$W^1-O-W^2$ (E)

in which each of $W^1$, $W^2$ and $W^3$ independently is an alkyl group, a cycloalkyl group, an alkenyl group, a aryl group or a heterocyclic group, each of which may have one or more substituent groups; $W^4$ is $-W^1$, $-O-W^1$ or $-S-W^1$; n is 1, 2, 3, 4 or 5; when n is two or more, the groups represented by $W^4$ may be different from each other; and $W^1$ and $W^2$ in the formula (E) may form a ring.

The couplers can be emulsified or dispersed in a hydrophilic colloidal solution by immersing a loadable latex polymer in the couplers (cf., U.S. Pat. No. 4,203,716), or dissolving the couplers in a water-insoluble and organic solvent-soluble polymer. In these cases, the above-mentioned organic solvent can be used together with the couplers. Preferred examples of the polymers are homopolymers and copolymers described at pages 12–30 in International Provisional Publication No. W088/00723. Acrylamide polymers are particularly preferred, since they improve the stability of the color image.

The photosensitive material of the present invention can contain hydroquinone derivatives, aminophenol derivatives, gallic acid derivatives and ascorbic acid derivatives as anticolorfogging agents.

The photosensitive material of the invention can contain an ultraviolet absorbent. Examples of the absorbent include benzotriazoles substituted with an aryl group (cf., U.S. Pat. No. 3,533,794); 4-thiazolidones (cf., U.S. Pat. No. 3,314,794 and No. 3,352,681); benzophenones (cf., Japanese Patent Provisional Publication No. 46(1971)-(2784); cinamic esters (cf., U.S. Pat. No. 3,705,805 and No. 3,707,375); butadienes (cf., U.S. Pat. No. 4,045,229); and benzoxydoles (cf., U.S. Pat. No. 3,700,455). A coupler having a function of absorbing an ultraviolet ray (e.g., α-naphthol cyan coupler) and a polymer having the absorbing function are also available. A particular layer can be dyed with the ultraviolet absorbent.

The photosensitive material of the present invention can further contain a water-soluble dye in a hydrophilic colloidal layer as a filter dye or an antiirradiation dye. Examples of the dye include oxonol dyes, hemioxonol dyes, styryl dyes, merocyanine dyes, cyanine dyes and azo dyes. Oxonol dyes, hemioxonol dyes and merocyanine dyes are particularly preferred.

Gelatin is preferably used as a binder or a protective colloid for the emulsion layer of the photosensitive material of the invention. The other hydrophilic polymers can be used singly or in combination with gelatin.

In the present invention, limed gelatin and acid-processed gelatin are available. The process for preparation of gelatin is described in Arther Vice, "The Macromolecular Chemistry of Gelatin" (Academic Press, 1964).

As the support for the photosensitive material of the present invention, a transparent film, such as cellulose nitrate film and polyethylene terephthalate film, and a reflective support are available. The reflective support is preferably used in the present invention.

In the present invention, the reflective support has a function of making clear a dye image formed on the silver halide emulsion layer by the reflection. The reflective support can be prepared by coating a base sheet with a hydrophobic resin which contains reflective substances, such as titanium dioxide, zinc oxide, calcium carbonate, calcium sulfate. The hydrophobic resin in which the reflective substances are dispersed is itself also available as the reflective support. Further, a baryta paper, a paper coated with polyethylene and a polypropylene synthetic paper are available. Examples of the base sheet to be coated with the reflective substances include various transparent materials, such as grass board, polyester film (e.g., polyethylene terephthalate film, cellulose triacetate film and cellulose nitrate film), polyamide film, polycarbonate film, polystyrene film and vinyl chloride film. The support is selected from the above-mentioned materials according to use of the photosensitive material.

It is preferred that the reflective substances, such as white pigments are finely dispersed on the support by mixing the substances and hydrophobic resin with a surface active agent. The surface of the pigments is preferably treated with a di-, tri- or tetrahydric alcohol.

The ratio of the area occupied by the white pigments (%) is determined by measuring the ratio (%) ($R_i$) of the area projected from the particles of the white pigments to a unit area. The observed area has been divided by the unit area (6 μm×6 μm). The coefficient of the variation with respect to the ratio of the occupied area is $s\sqrt{R}$ in which "s" means a standard deviation of $R_i$, and "R " means the average value of $R_i$. The number of the unit areas to be measured is preferably not less than 6. The coefficient of the variation ($s\sqrt{R}$) is calculated from the following formula.

$$\sqrt{\frac{\sum_{i=1}^{n}(R_i-\overline{R})^2}{n-1}} \Big/ \frac{\sum_{i=1}^{n} R_i}{n}$$

In the present invention, the coefficient of the variation with respect to the ratio of the area occupied by the pigment is preferably not more than 0.15, and more preferably not more than 0.12. When the coefficient is not more than 0.08, the particles are substantially "uniformly" dispersed.

The color photosensitive material of the present invention is preferably processed by color development, bleach-fix and washing (or stabilization). The bleach and the fix can be separately conducted.

In continuous processing, the amount of the replenishing developing solution is preferably as small as possible for saving resources and preventing pollution.

The replenishing amount of the color developing solution is preferably not more than 200 ml per 1 $m^2$ of the photosensitive material, more preferably not more than 120 ml, and most preferably not more than 100 ml. The above-defined replenishing amount only relates to the amount of the replenishing color developing solution, and does not include the additives which adjust the developing solution to change of the quality and concentration of the solution. Examples of the additives include water which dilutes the condensed solution, preservatives which tend to be degraded, and alkali which keeps the pH value high.

The color developing solution used in the present invention preferably is an alkaline solution which mainly contains an aromatic primary amine color developing agent. Aminophenols and p-phenylenediamines are available as the color developing agent. P-phenylenediamines are particularly preferred. Examples of the developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline and 3-ethyl-4-amino-N-ethyl-N-β-methoxyethylaniline. Sulfate, hydrochloride and p-toluenesulfonate of these compounds are also available. Two or more compounds can be used in combination.

The color developing solution generally contains a pH buffer (e.g., carbonate, borate or phosphate of alkali metal) and a development inhibitor or an antifogging agent (e.g., bromide salts, iodide salts, benzimidazoles, benzothiazoles and mercapto compounds). The developing solution can further contain various preservatives (e.g., hydroxyamines, diethylhydroxyamines, hydrazines sulfites, phenylsemicarbazides, triethanolamine, catechol sulfates, triethylenediamine and 1,4-diazabicyclo[2,2,2]octane); organic solvents (e.g., ethylene glycol and diethylene glycol); development accelerators (e.g., benzyl alcohol, polyethylene glycol and tertially ammonium salts); fogging agents (e.g., dye-forming couplers, competitive couplers and sodium boron hydride); complementary developing agents (e.g., 1-phenyl-3-pyrazolidone); viscosity agents; and chelating agent such as aminopolycarboxylic acids, aminopolyphosphonic acid and phosphorylcarboxylic acids (e.g, ethylenediaminetetraacetic acid, nitrilotriacetic acid, diethylenetriaminepentaacetic acid, cyclohexanediaminetetraacetic acid, hydroxyethyimidinoacetic acid, 1-hydroxyethylidene-1,1-diphosphonic acid, nitrilo-N,N,N-trimethylenephosphonic acid, ethylenediamine-di(o-hydroxyphenyl)acetic acid and the salts thereof).

In a reversal development, a black and white development is usually followed by a color development. The developing solution for the black and white development contains the known black and white developing agents, such as dihydroxybenzenes (e.g., hydroquinone), 3-pyrazolidones (e.g., 1-phenyl-3-pyrazolidone) and aminophenols (e.g., N-methyl-p-aminophenol). These agents can be used in combination.

The pH value of the color developing solution or the black and white developing solution is generally in the range of 9 to 12. The replenishing amount of the developing solution is usually not more than 3 l per 1 $m^2$ of the color photosensitive material. The replenishing amount can be reduced to not more than 500 ml by reducing the concentration of bromide ion in the replenishing solution. When the replenishing amount is reduced, it is preferred to prevent the solution from the evaporation or the air oxidation by minimize the contact surface of the solution to the air. Further, a means of restraining accumulation of bromide ion in the developing solution can be employed to reduce the replenishing amount.

After the color development, the photographic emulsion layer is usually bleached. The bleach can be conducted together with the fix (bleach-fix process). The bleach and the fix can be separately conducted. Further, the bleach process can be followed by the bleach-fix process for rapid development. Furthermore, a continuous processing using two bleaching baths, a fix process followed by a bleach-fix process and a bleach-fix process followed by a bleach process can be employed. As the bleaching agent, compounds of polyvalent metals such as iron (III), cobalt (III), chromium (VI), copper (II), peracids, quinones and nitro compounds are available. Examples of the bleaching agent include ferricyanides; bichromates: organic complexes of iron (III) or cobalt (III), such as complexes of aminopolycarboxylic acids (e.g., ethylenediaminetetraacetic acid, diethylene triaminepentaacetic acid, cyclohexanediaminetetraacetic acid, methyliminodiacetic acid, diaminopropanetetraacetic acid, glycoletherdiaminetetraacetic acid), citric acid, tartaric acid and malic acid; persulfates; bromates; permanganates; and nitrobenzenes. Iron (III) complexes of aminopolycarboxylic acids (e.g., iron (III) complex of ethylenediaminetatraacetic acid) and persulfates are preferred, since these compounds are advantageous to the rapid processing and the prevention of pollution. Iron (III) complexes of aminopolycarboxylic acids are available in both of bleaching bath and bleach-fix bath. The pH value in the bleaching or bleach-fix bath using the iron (III) complexes of aminopolycarboxylic acids is usually in the range of 5.5 to 8. The pH value can be further lowered for the rapid processing.

A bleaching accelerator can be used in the bleaching bath, the bleach-fix bath or the prebath thereof. Examples of the bleaching accelerator include compounds having a mercapto group or a disulfide group (cf., U.S. Pat. No. 3,893,858, German Patents No. 1,290,812 and No. 2,059,988, Japanese Patent Provisional Publications No. 53(1978)-32736, No. 53(1978)-57831, No. 53)(1978)-37418, No. 53(1978)-72623, No. 53(1978)-95630, No. 53(1978)-95631, No. 53(1978)104232, No. 53(1978)-124424 and No. 53(1978)-141623, No. 53(1978)-24826, and Research Disclosure No. 17,129 (Jul. 1978)); thiazolidine derivatives (cf., Japanese Patent Provisional Publication No. 50(1975)-140129); thiourea derivatives (cf., Japanese Patent Publication No. 45(1970)-8506, Japanese Patent Provisional Publications No. 52(1977)-20832 and No. 53(1978)-32735, and U.S. Pat. No. 3,706,561); iodides (cf., German Patent No. 1,127,715, and Japanese Patent Provisional Publication No. 58(1983)-16235); polyoxyethylene compounds (cf., German Patents No. 996,410 and No. 2,748,430); polyamines (cf., Japanese Patent Publication No. 45(1970)-8836); the other compounds described in Japanese Patent Provisional Publications No. 49(1974)-42434, No. 49(1974)-59644, No. 53(1978)-94927, No. 54(1979)-35727, No. 55(1980)-26506 and No. 58(1983)-163940; and bromide ion. The compounds having a mercapto group or a disulfide group are preferred, since they have a strong effect. The compounds described in U.S. Pat. No. 3,893,858, German Patent No. 1,290,812 and Japanese Patent Provisional Publication No. 53(1978)-95630 are particularly preferred. The compounds described in U.S. Pat. No. 4,552,834 are also preferred. The above-mentioned bleaching accelerator can be added to the photosensitive material. The bleaching accelerator is particularly effective in the bleach-fix process of a color photosensitive material.

Examples of the fixing agent include thiosulfates, thiocyanates, thioethers, thioureas and iodide salts which are used in a relatively large amount. Thiosulfates are usually used. Sodium thiosulfate is particularly available in various fields. Examples of the preservatives for the bleach-fix solution include sulfite salts, bisulfite salts and carbonyl adducts of bisulfite.

In the process of the silver halide color photosensitive material of the present invention, a washing process and/or stabilization process is conducted after a desilvering process. The amount of water in the washing process is determined according to the nature of the photosensitive material (e.g., the nature of the components such as coupler), use of the material, temperature of washing water, the number of washing tanks (washing stages), the replenishing method (countercurrent or not), and the other conditions.The relation between the number of washing tanks and the amount of water in a multistage countercurrent method is described in Journal of the Society of Motion Picture and Television Engineers, vol. 64, p. 248–253 (May, 1955).

According to the multistage countercurrent method described in the above-mentioned document, the amount of washing water can be greatly reduced. However, this method has a disadvantage of increasing the stagnant time of water in a tank. This disadvantage further causes a problem that the propagation of bacteria causes a suspended matter, which is attached to the photosensitive material. In order to solve the problem, the method of reducing the amount of calcium ion and magnesium ion described in Japanese Patent Application No. 61(1986)-131632 is effective. Further, isothiazolone compounds and cyabendazoles described in Japanese Patent Provisional Publication No. 57(1982)-8542, chlorine germicides such as chlorinated sodium isocyanurate, and benzotriazole are available as germicide.

The pH value of washing water in the process of the photosensitive material of the invention preferably is in the range of 4 to 9, and more preferably in the range of 5 to 9. The temperature of washing water and the washing time are determined according to the nature and use of the photosensitive material. The washing process is usually conducted at 15° to 45 ° C. for 20 seconds to 10 minutes, and more preferably at 25° to 40 ° C. for 30 seconds to 5 minutes. The photosensitive material of the invention can be directly processed by a stabilizer in place of the above-mentioned washing process. The stabilization process can be conducted by the known methods which are described in Japanese Patent Provisional Publications No. 57(1982)-8543, No. 58(1983)-14834 and No. 60(1985)-220345.

The stabilization process can follow the washing process. A example of such process is the last bath of a color photosensitive material, which is a stabilization bath containing formaldehyde and a surface active agent. The stabilization bath can further contain various chelating agents and germicides.

The overflow solution caused by replenishing the washing and/or stabilization solution can be recycled in the other process such as a desilvering process.

The silver halide color photosensitive material of the present invention can contain a color developing agent for simple and rapid processing. The color developing agent is preferably in the form of a precursor to be contained in the photosensitive material. Examples of the precursor of the agent include indoaniline compounds (cf., U.S. Pat. No. 3,342,597), Schiff base compounds (cf., U.S. Pat. No. 3,342,599, and Research Disclosures No. 14,850 and No. 15,159), aldole compounds (cf., Research Disclosure No. 13,924), metal salt complexes (cf., U.S. Pat. No. 3,719,492) and urethane compounds (cf., Japanese Patent Provisional Publication No. 53(1978)-135628).

The silver halide color photosensitive material of the invention can contain various 1-phenyl-3-pyrazolidones to accelerate the color development. Examples of the compounds are described in Japanese Patent Provisional Publications No. 56(1981)-64339, No. 57(1982)-144547 and No. 58(1983)-115438.

In the present invention, the various processing solutions are used at 10° to 50 ° C., and usually at 33° to 38 ° C. A higher temperature can be employed to accelerate the process or to shortening the processing time. A lower temperature can also be employed to improve the quality of the image or the stability of the processing solution. To save the amount of silver contained in the photosensitive material, an intensification process using cobalt or hydrogen peroxide is available. The intensification process is described in German Patent No. 2,226,770 and U.S. Pat. No. 3,674,499.

In order to exhibit the excellent character of the silver halide photosensitive material, the material is preferably processed for not more than 2 minutes and 30 seconds using a color developing solution which substantially es not contain benzyl alcohol and contains bromide ion in an amount of not more than 0.002 mole/1.

The term "not contain benzyl alcohol" means the amount of not more than 2 ml per 1 l of the color developing solution. The amount is preferably not more than 0.5 ml. It is most preferred that the developing solution completely does not contain benzyl alcohol.

The present invention is further described by the following examples without limiting the invention.

EXAMPLE 1

A silver halide emulsion (1) for a blue sensitive silver halide emulsion layer was prepared according to the following process.

| | |
|---|---|
| (Liquid 1) | |
| $H_2O$ | 100 ml |
| NaCl | 8.8 g |
| Gelatin | 25 g |
| (Liquid 2) | |
| Sulfonic Acid (1N) | 20 ml |
| (Liquid 3) | |
| The following compound (1% solution) | 3 ml |

-continued

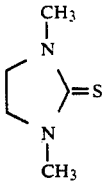

| | |
|---|---|
| (Liquid 4) | |
| KBr | 14.01 g |
| NaCl | 1.72 g |
| $H_2O$ | to make up to 130 ml |
| (Liquid 5) | |
| $AgNO_3$ | 25 g |
| $H_2O$ | to make up to 130 ml |
| (Liquid 6) | |
| KBr | 56.03 g |
| NaCl | 6.88 g |
| $K_2IrCl_6$ (0.001% solution) | 1.0 ml |
| $H_2O$ | to make up to 285 ml |
| (Liquid 7) | |
| $AgNO_3$ | 100 g |
| $NH_4NO_3$ (50% solution) | 2 ml |
| $H_2O$ | to make up to 285 ml |

The liquid (1) was heated at 75° C., and the liquids (2) and (3) were added to the liquid (1). The liquids (4) and (5) were simultaneously added to the mixture for 40 minutes. After 10 minutes, the liquids (6) and (7) were further simultaneously added to the mixture for 25 minutes. After 5 minutes, the mixture was cooled and desalted. Water and gelatin dispersion were added to the mixture. The mixture was then adjusted to pH 6.2 to obtain a silver chlorobromide emulsion (1), which has average grain size of 1.01 μm, such uniform grain size distribution that the coefficient of variation (S/d, wherein "S" means a standard deviation and "d" means the average grain size) is 0.08, 80 mole % silver bromide content, and cubic grain shape. The emulsion was subjected to a chemical sensitization using triethylthiourea under best conditions.

A silver halide emulsion (2) for a blue sensitive silver halide emulsion layer, silver halide emulsions (3) and (4) for a green sensitive silver halide emulsion layer, and silver halide emulsions (5) and (6) for a red sensitive silver halide emulsion layer were prepared in a similar manner except that the amount of the agents, and the temperature and time in the process were changed.

The shape of the grain, the average grain size, the halogen composition and the coefficient of variation with respect to the silver halide emulsions (1) to (6) are set forth below.

| Silver Halide Emulsion | Shape of Grain | Average Grain Size | Halogen Composition (Mole % of Br) | Coefficient of Variation |
|---|---|---|---|---|
| (1) | Cubic | 1.01 μm | 80 | 0.08 |
| (2) | Cubic | 0.70 μm | 80 | 0.07 |
| (3) | Cubic | 0.52 μm | 80 | 0.08 |
| (4) | Cubic | 0.40 μm | 80 | 0.09 |
| (5) | Cubic | 0.44 μm | 70 | 0.09 |
| (6) | Cubic | 0.36 μm | 70 | 0.08 |

A paper was laminated with polyethylene on the both side to prepare a paper support. On the paper support, the following coating solution were coated to prepare a multi-layered color photosensitive material.

Preparation of Coating Solution for the First Layer

In 27.2 ml of methyl acetate, 3.8 ml of a solvent (Solv-1) and 3.8 ml of a solvent (Solv-2) were dissolved 19.1 g of a yellow coupler (Y-45) and 0.46 g of an antifogging agent (Cpd-2). The solution was emulsified in 185 ml of 10% aqueous gelatin solution containing 8 ml of 10% solution of sodium dodecylbenzenesulfonate. Separately, to the mixture of the silver halide emulsions (1) and (2) (the ratio of (1) to (2) is 6:4) was added the following blue sensitive spectral sensitizing dye in the amount of $5.0\times10^{-4}$ mole per the 1 mole of silver. The previously prepared emulsion is mixed with the mixture of the silver halide emulsions to prepare a coating solution for the first layer.

The coating solutions for the second to seventh layers were prepared in a similar manner.

As the hardening agent for the layers, sodium salt of 1-oxy-3,5-dichloro-s-triazine (hardening agent for gelatin) was used.

The following spectral sensitizing dyes were used for the layers.

(Dye for blue sensitive emulsion layer)

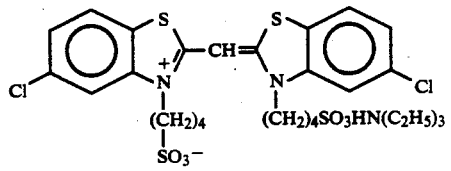

($5.0\times10^{-4}$ mole per 1 mole of emulsion)

(Dye for green sensitive emulsion layer)

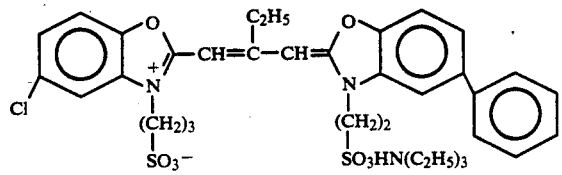

($4.0\times10^{-4}$ mole per 1 mole of emulsion)

-continued

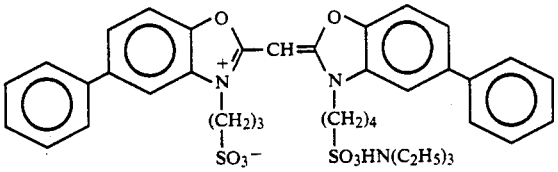

($7.0 \times 10^{-4}$ mole per 1 mole of emulsion)

(Dye for red sensitive emulsion layer)

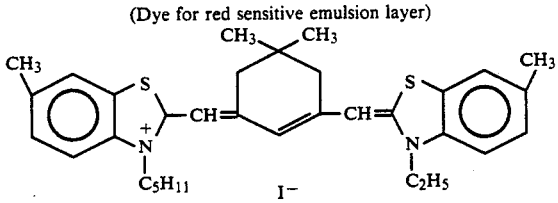

($0.9 \times 10^{-4}$ mole per 1 mole of emulsion)

To the red sensitive emulsion layer was added $2.6\times10^{-3}$ mole (per 1 mole of silver halide) of the following compound.

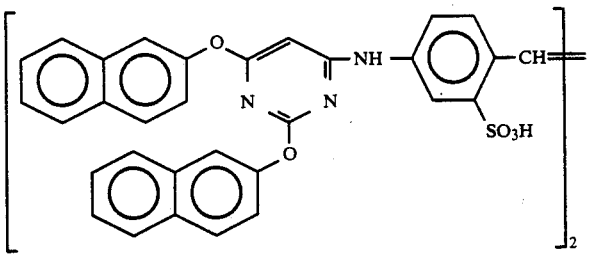

To the blue sensitive emulsion layer was added $1.2\times10^{-2}$ mole (per 1 mole of silver halide) of 4-hydroxy-6-methyl-1,3,3a,7-tetraazaindene. Further, to the green sensitive emulsion layer was added $1.1\times10^{-2}$ mole of 4-hydroxy-6-methyl-1,3,3a,7-tetraazaindene.

To the green sensitive emulsion layer was added $1.0\times10^{-3}$ mole (per 1 mole of silver halide) of 1-(5-methylureidophanyl)-5-mercaptotetrazole.

To the red sensitive emulsion layer was added $3.0\times10^{-4}$ mole (per 1 mole of silver halide) of 2-amino-5-mercapto-1,3,4-thiadiazole.

As the antiirradiation dye, the following compounds were used.

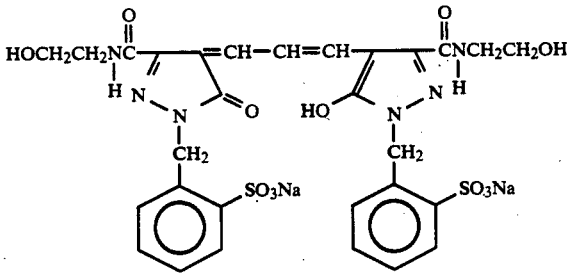

and

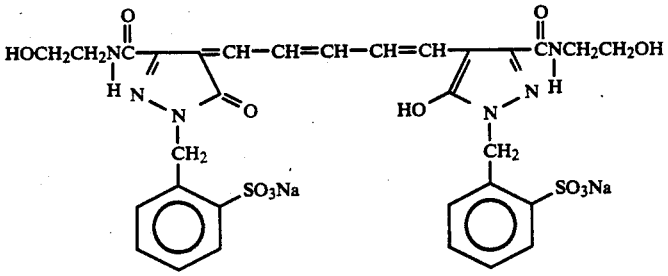

The composition of each of the layers set forth below. Each of the values means the coating amount (g/m$^2$), except that the values for the silver halide emulsions mean the coating amount of silver.

Support

Paper support (laminated with polyethylene on the both sides of paper)

[the polyethylene lamination on the side of the first layer contains white pigment ($TiO_2$) and blue dye (ultramarine)

| | |
|---|---|
| The first layer (Blue sensitive layer) | |
| Silver halide emulsion (1) + (2) | 0.26 |
| Gelatin | 1.20 |
| Yellow coupler (Y-45) | 0.66 |
| Antifogging agent (Cpd-2) | 0.02 |
| Solvent (Solv-1) | 0.13 |
| Solvent (Solv-2) | 0.13 |
| The second layer (Color stain inhibiting layer) | |
| Gelatin | 1.34 |
| Color stain inhibitor (Cpd-3) | 0.04 |
| Solvent (Solv-3) | 0.10 |
| Solvent (Solv-4) | 0.10 |
| The third layer (Green sensitive layer) | |
| Silver halide emulsion (3) + (4) | 0.14 |
| Gelatin | 1.30 |
| Magenta coupler (ExM) | 0.27 |
| Color stabilizer (Cpd-5) | 0.16 |
| Stain inhibitor (Cpd-8) | 0.025 |
| Stain inhibitor (Cpd-9) | 0.032 |
| Solvent (Solv-3) | 0.21 |
| Solvent (Solv-5) | 0.33 |
| The fourth layer (Ultraviolet absorbing layer) | |
| Gelatin | 1.44 |
| Ultraviolet absorbent (UV-1) | 0.53 |
| Color stain inhibitor (Cpd-2) | 0.05 |
| Solvent (Solv-2) | 0.26 |
| The fifth layer (Red sensitive layer) | |
| Silver halide emulsion (5) + (6) | 0.20 |
| Gelatin | 0.89 |
| Cyan coupler (ExC-1) | 0.13 |
| Cyan coupler (ExC-2) | 0.16 |
| Color stabilizer (Cpd-1) | 0.27 |
| Color stabilizer (Cpd-6) | 0.07 |
| Antifogging agent (Cpd-2) | 0.01 |
| Solvent (Solv-1) | 0.19 |
| The sixth layer (Ultraviolet absorbing layer) | |
| Gelatin | 0.47 |
| Ultraviolet absorbent (UV-1) | 0.17 |
| Solvent (Solv-2) | 0.08 |
| The seventh layer (Protective layer) | |
| Gelatin | 1.25 |
| Acrylated copolymer of polyvinyl alcohol (the acrylated ratio is 17%) | 0.17 |
| Liquid paraffin | 0.02 |

(ExM; Magenta coupler)

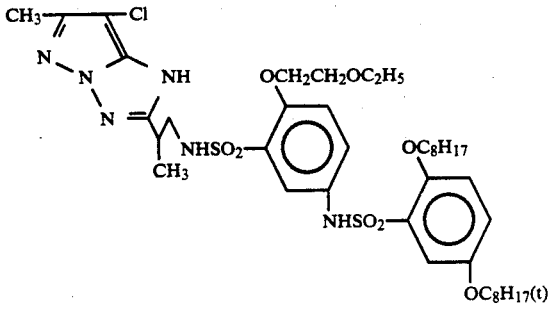

(ExC-1; Cyan coupler)

-continued

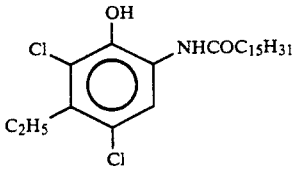

(ExC-2; Cyan coupler)

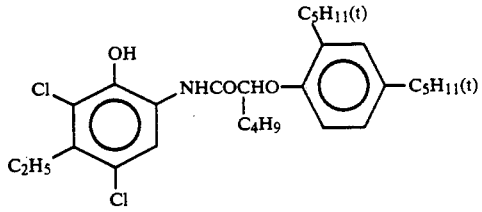

(Cpd-1; Color stabilizer)

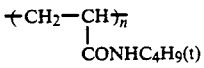

(Average molecular weight is 60,000)
(Cpd-2; Antifogging agent)

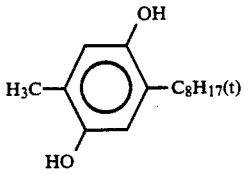

(Cpd-3; Color stain inhibitor)

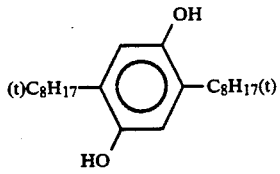

(Cpd-4; Color stabilizer)

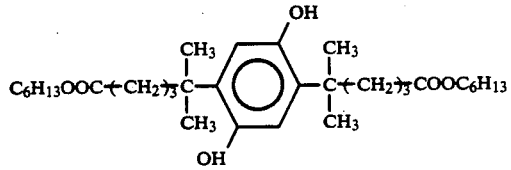

(Cpd-5)

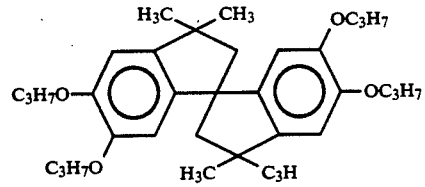

(Cpd-6; Color stabilizer)
Mixture of the following compounds (4:2:5 as weight ratio)

-continued

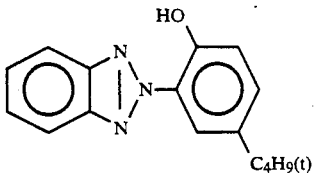

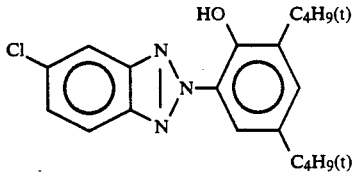

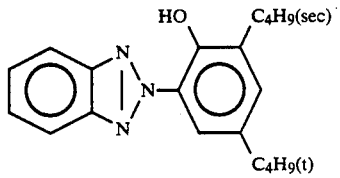

(Cpd-8; Stain inhibitor)

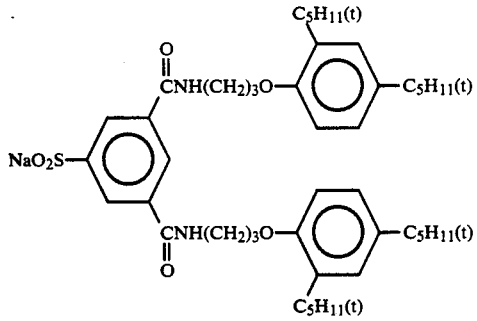

(Cpd-9; Stain inhibitor)

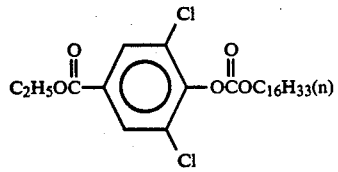

(UV-6; Ultraviolet absorbent)
Mixture of the following compounds (12:10:3 as weight ratio)

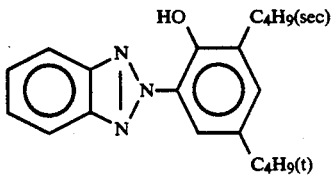

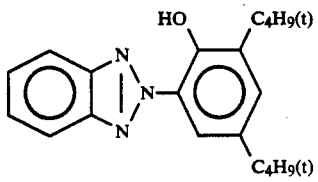

-continued

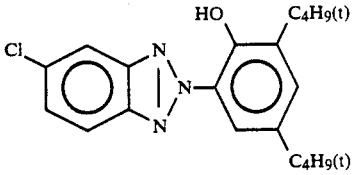

(Solv-1; Solvent)

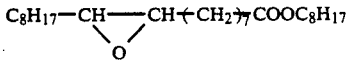

(Solv-2; Solvent)

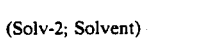

(Solv-3; Solvent)

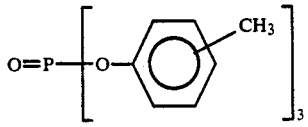

(Solv-4; Solvent)

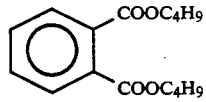

(Solv-5; Solvent)

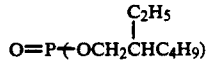

The above-prepared photosensitive material was exposed to light through an optical wedge, and subjected to the following processes.

| Process | Temperature | Time |
|---|---|---|
| Color Development | 37° C. | 3 minutes & 30 seconds |
| Bleach-fix | 33° C. | 1 minute & 30 seconds |
| Washing | 24 to 34° C. | 3 minutes |
| Drying | 70 to 80° C. | 1 minute |

The composition of each of the processing solution is set forth below.

| | |
|---|---|
| Color developing solution | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| Sulfonate salt of N-ethyl-N-(b-methanesulfonamidoethyl)-3-methyl-4-aminoaniline | 4.5 g |
| Sulfonate salt of hydroxyamine | 3.0 g |
| Brightening agent (WHITEX4B, produced by Sumitomo Chemical Co., Ltd.) | 1.0 g |
| Water to make up to | 1000 ml |
| pH (25° C.) | 10.25 |
| Bleach-fix solution | |
| Water | 400 ml |
| Ammonium thiosulfate (70% solution) | 150 ml |
| Sodium sulfite | 18 g |

-continued

| | |
|---|---|
| Ethylenediaminetetraacetic acid iron (III) ammonium salt | 55 g |
| Ethylenediaminetetraacetic acid disodium salt | 5 g |
| Sulfonate salt of hydroxyamine | 3.0 g |
| Water to make up to | 1000 ml |
| pH (25° C.) | 6.70 |

Thus, a sample 1A was obtained. The other samples were prepared in the same manner except that the yellow coupler and an additive (color stabilizer) [50 mole % based on the amount of the coupler] contained in the first layer were changed according to the following Table 1.

Each of the samples, on which an image had been formed, was irradiated with light for 8 days in a xenon tester at 200,000 lux. The density of the image was measured, and the remaining ratio to the density of the image (1.0) before the irradiation was obtained.

The stability to heat was measured by placing the samples at 100 ° C. for 400 hours. The remaining ratio to the density of the image (1.0) before heating was obtained.

The results are set forth in Table 1. The density was measured using Macbeth's densitometer RD.514 (Status, AA filter). In Table 1, the "Remaining Ratio to Light" shows the results of the remaining ratio after irradiation, and the "Remaining Ratio to Light" shows the results of the remaining ratio after heating. Further, the "Remark" indicates whether the experiment is a comparison example (Comp.) or an example of the present invention (Example).

TABLE 1

| Sample | Yellow Coupler | Stabilizer | Remaining Ratio Light | Remaining Ratio Heat | Remark |
|---|---|---|---|---|---|
| 1A | Y-45 | — | 68% | 80% | Comp. |
| 1B | Y-45 | (A-3) | 85% | 89% | Example |
| 1C | Y-45 | (A-6) | 82% | 90% | Example |
| 1D | Y-45 | (A-11) | 90% | 92% | Example |
| 1E | Y-45 | (A-13) | 92% | 92% | Example |
| 1F | Y-45 | (A-20) | 92% | 91% | Example |
| 1G | Y-45 | (A-23) | 88% | 90% | Example |
| 1H | Y-45 | (a) | 72% | 82% | Comp. |
| 1I | Y-45 | (b) | 77% | 85% | Comp. |
| 1J | Y-45 | (c) | 73% | 82% | Comp. |
| 1K | Y-45 | (d) | 69% | 82% | Comp. |
| 1L | Y-45 | (e) | 70% | 84% | Comp. |
| 1M | Y-10 | — | 65% | 79% | Comp. |
| 1N | Y-10 | (A-11) | 88% | 88% | Example |
| 1O | Y-10 | (A-22) | 90% | 90% | Example |
| 1P | Y-10 | A-32 | 88% | 90% | Example |
| 1Q | Y-10 | (a) | 70% | 81% | Comp. |
| 1R | Y-10 | (e) | 72% | 84% | Comp. |
| 1S | Y-49 | — | 70% | 78% | Comp. |
| 1T | Y-49 | (A-12) | 88% | 90% | Example |

It is apparent from the results that the compounds of the present invention is much effective in preventing the color image from light fading, compared with the following comparative compounds (a), (b), (c), (d) and (e). It is also apparent that the compounds of the present invention is much effective in preventing the color image from heat fading.

(Comparative compound (a))

-continued

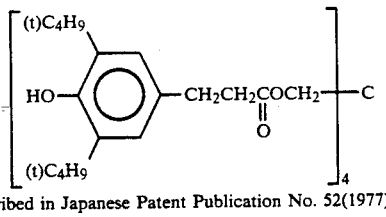

(Described in Japanese Patent Publication No. 52(1977)-6623)

(Comparative compound (b))

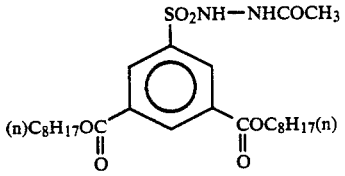

(Described in European Patent No. 255,722)

(Comparative compound (c))

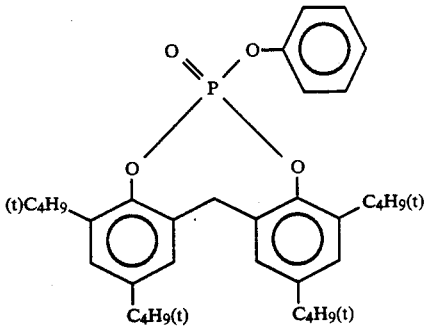

(Described in U.S. Pat. No. 4,749,645)

(Comparative compound (d))

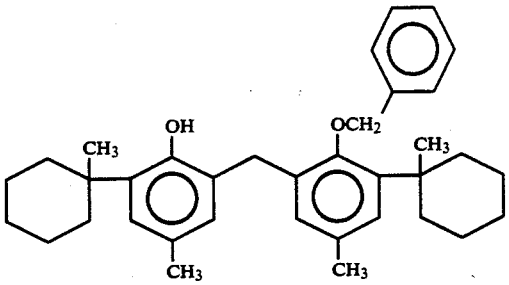

(Described in European Patent No. 246,766)

(Comparative compound (e))

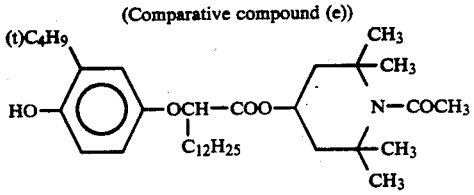

(Described in European Patent No. 114,029)

EXAMPLE 2

A silver halide emulsion (1) for a blue sensitive silver halide emulsion layer was prepared according to the following process.

| (Liquid 1) | |
|---|---|
| $H_2O$ | 1000 ml |
| NaCl | 5.8 g |
| Gelatin | 25 g |

-continued

| | |
|---|---|
| (Liquid 2) | |
| Sulfonic Acid (1N) | 20 ml |
| (Liquid 3) | |
| The following compound (1% solution) | 3 ml |

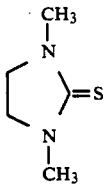

| | |
|---|---|
| (Liquid 4) | |
| KBr | 0.18 g |
| NaCl | 8.51 g |
| $H_2O$ | to make up to 130 ml |
| (Liquid 5) | |
| $AgNO_3$ | 25 g |
| $H_2O$ | to make up to 130 ml |
| (Liquid 6) | |
| KBr | 0.70 g |
| NaCl | 34.05 g |
| $K_2IrCl_6$ (0.001% solution) | 2 ml |
| $H_2O$ | to make up to 285 ml |
| (Liquid 7) | |
| $AgNO_3$ | 100 g |
| $H_2O$ | to make up to 285 ml |

The liquid (1) was heated at 60° C., and the liquids (2) and (3) were added to the liquid (1). The liquids (4) and (5) were simultaneously added to the mixture for 60 minutes. After 10 minutes, the liquids (6) and (7) were further simultaneously added to the mixture for 25 minutes. After 5 minutes, the mixture was cooled and desalted. Water and a gelatin dispersion were added to the mixture. The mixture was then adjusted to pH 6.0 to obtain a silver chlorobromide emulsion (1), which has average grain size of 1.0 μm, such uniform grain size distribution that the coefficient of variation (S/d, wherein "S" means a standard deviation and "d" means the average grain size) is 0.11, 1 mole % silver bromide content, and cubic grain shape. The emulsion was subjected to a chemical sensitization using triethylthiourea under best conditions. To the silver halide emulsion was further added the following spectral sensitizing dye (Sen-1) in the amount of $7\times10^{-4}$ mole per the 1 mole of the silver halide emulsion.

A silver halide emulsion (2) for a green sensitive silver halide emulsion layer, and silver halide emulsion (3) for a red sensitive silver halide emulsion layer were prepared in a similar manner except that the amount of the agents, and the temperature and time in the process were changed.

To the silver halide emulsion (2) was the following spectral sensitizing dye (Sen-2) in the amount of $5\times10^{-4}$ mole per the 1 mole of the emulsion. To the silver halide emulsion (3) was the following spectral sensitizing dye (Sen-3) in the amount of $0.9\times10^{-4}$ mole per the 1 mole of the emulsion.

The shape of the grain, the average grain size, the halogen composition and the coefficient of variation with respect to the silver halide emulsions (1) to (3) are set forth below.

| Silver Halide Emulsion | Shape of Grain | Average Grain Size | Halogen Composition (Mole % of Br) | Coefficient of Variation |
|---|---|---|---|---|
| (1) | Cubic | 1.00 μm | 1.0 | 0.11 |
| (2) | Cubic | 0.45 μm | 1.0 | 0.09 |
| (3) | Cubic | 0.34 μm | 1.8 | 0.10 |

(Sen-1)

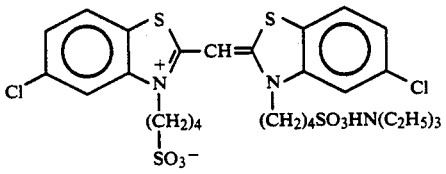

(Sen-2)

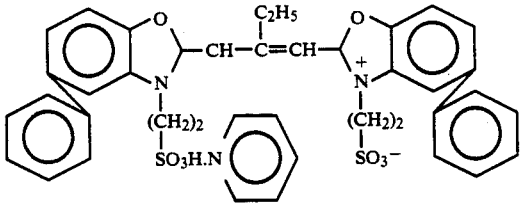

(Sen-3)

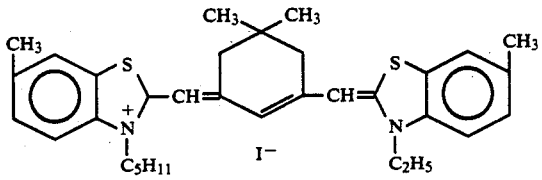

A multilayered color photosensitive material was prepared using the above-prepared silver halide emulsions (1) to (3). The coating solution was prepared in the following manner.

PREPARATION OF COATING SOLUTION FOR THE FIRST LAYER

In 27.2 ml of methyl acetate and 3.8 ml of a solvent (Solv-1) was dissolved 19.1 g of a yellow coupler (Y-45). The solution was emulsified in 185 ml of 10% aqueous gelatin solution containing 8 ml of 10% solution of sodium dodecylbenzenesulfonate. Separately, to the silver halide emulsion (1) was added the blue sensitive spectral sensitizing dye (Sen-1) in the amount of $5.0\times10^{-4}$ mole per the 1 mole of silver. The previously prepared emulsion is mixed with the silver halide emulsion to prepare a coating solution for the first layer.

The coating solutions for the second to seventh layers were prepared in a similar manner.

As the hardening agent for the layers, sodium salt of 1-oxy-3,5-dichloro-s-triazine (hardening agent for gelatin) was used.

To the red sensitive emulsion layer was added $1.9\times10^{-3}$ mole (per 1 mole of silver halide) of the following compound.

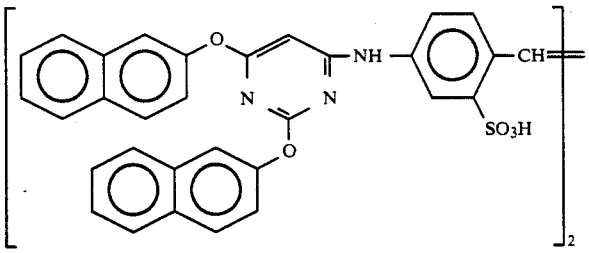

To the blue sensitive emulsion layer was added $1.0\times10^{-2}$ mole (per 1 mole of silver halide) of 4-hydroxy-6-methyl-1,3,3a,7-tetraazaindene.

To the green sensitive emulsion layer was added $1.0\times10^{-3}$ mole (per 1 mole of silver halide) of 1-(5-methylureidophanyl)-5-mercaptotetrazole. To the green sensitive emulsion layer was added $1.5\times10^{-3}$ mole of 1-(5-methylureidophanyl)-5-mercaptotetrazole.

To the red sensitive emulsion layer was added $2.5\times10^{-4}$ mole (per 1 mole of silver halide) of 2-amino-5-mercapto-1,3,4-thiadiazole.

The composition of each of the layers set forth below. The meanings of the abbreviations and formulas for the compounds are the same as in Example 1.

Support

Paper support (laminated with polyethylene on the both sides of paper)

[the polyethylene lamination on the side of the first layer contains white pigment ($TiO_2$) (2.7 g/m$^2$) and blue dye (ultramarine)]

| | |
|---|---|
| The first layer (Blue sensitive layer) | |
| Silver halide emulsion (1) | 0.26 |
| Gelatin | 1.13 |
| Yellow coupler (Y-45) | 0.66 |
| Solvent (Solv-4) | 0.28 |
| The second layer (Color stain inhibiting layer) | |
| Gelatin | 0.89 |
| Color stain inhibitor (Cpd-3) | 0.08 |
| Solvent (Solv-4) | 0.20 |
| Solvent (Solv-3) | 0.20 |
| Dye (T-1) | 0.005 |
| The third layer (Green sensitive layer) | |
| Silver halide emulsion (2) | 0.15 |
| Gelatin | 0.51 |
| Magenta coupler (ExM) | 0.27 |
| Color stabilizer (Cpd-5) | 0.10 |
| Color stabilizer (Cpd-8) | 0.02 |
| Color stabilizer (Cpd-9) | 0.03 |
| Solvent (Solv-3) | 0.19 |
| Solvent (Solv-5) | 0.15 |
| The fourth layer (Ultraviolet absorbing layer) | |
| Gelatin | 1.42 |
| Ultraviolet absorbent (UV-1) | 0.52 |
| Color stain inhibitor (Cpd-3) | 0.06 |
| Solvent (Solv-2) | 0.26 |
| Dye (T-2) | 0.015 |
| The fifth layer (Red sensitive layer) | |
| Silver halide emulsion (3) | 0.22 |
| Gelatin | 1.06 |
| Cyan coupler (ExC-3) | 0.16 |
| Cyan coupler (ExC-4) | 0.13 |
| Color stabilizer (Cpd-1) | 0.32 |
| Color stabilizer (Cpd-6) | 0.18 |
| Solvent (Solv-2) | 0.10 |
| Solvent (Solv-7) | 0.10 |
| Solvent (Solv-6) | 0.11 |
| The sixth layer (Ultraviolet absorbing layer) | |
| Gelatin | 0.48 |
| Ultraviolet absorbent (UV-1) | 0.18 |
| Solvent (Solv-2) | 0.08 |
| Dye (T-2) | 0.005 |
| The seventh layer (Protective layer) | |
| Gelatin | 1.33 |
| Acrylated copolymer of polyvinyl alcohol (the acrylated ratio is 17%) | 0.05 |
| Liquid paraffin | 0.03 |

(ExC-3; Cyan coupler) (ExC-4; Cyan coupler)

-continued

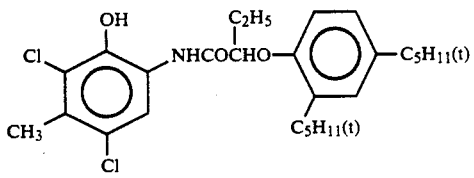

(Solv-6; Solvent)

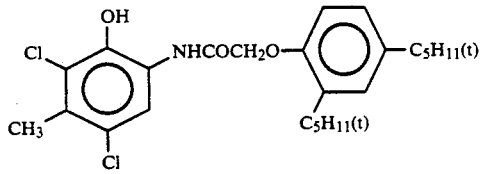

(Solv-7; Solvent)

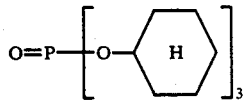

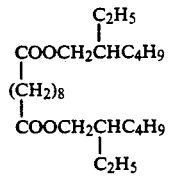

(T-1)

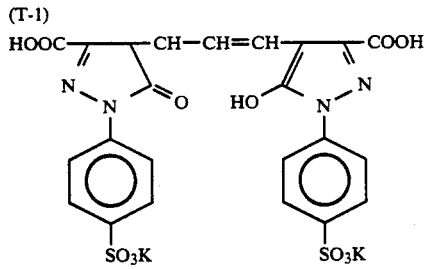

(T-2)

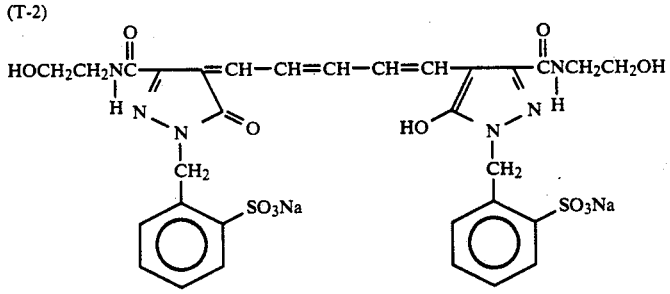

The above-prepared photosensitive material was exposed to light through an optical wedge, and subjected to the following processes.

| Process | Temperature | Time |
|---|---|---|
| Color Development | 35° C. | 45 seconds |
| Bleach-fix | 35° C. | 45 seconds |
| Washing (1) | 35° C. | 30 seconds |
| Washing (2) | 35° C. | 30 seconds |
| Washing (3) | 35° C. | 30 seconds |
| Drying | 75° C. | 60 seconds |

| Color developing solution | |
|---|---|
| Water | 800 ml |
| Ethylenediamine-N,N,N',N'- tetramethylene-phosphonic acid | 3.0 g |
| Triethanolamine | 8.0 g |
| Sodium chloride | 1.4 g |
| Potassium carbonate | 25 g |
| Sulfonate salt of N-ethyl-N-(b-methane-sulfonamidoethyl)-3-methyl-4-aminoaniline | 5.0 g |
| N,N-bis(carboxymethyl)hydrazine | 5.0 g |
| Brightening agent (WHITEX4B, produced by Sumitomo Chemical Co., Ltd.) | 1.0 g |
| Water to make up to | 1000 ml |
| pH (25° C.) | 10.05 |
| **Bleach-fix solution** | |
| Water | 700 ml |
| Ammonium thiosulfate solution (700 g/l) | 100 ml |
| Ammonium sulfite | 18 g |
| Ethylenediaminetetraacetic acid iron (III) ammonium salt | 55 g |
| Ethylenediaminetetraacetic acid disodium salt | 3 g |
| Ammonium bromide | 40 g |
| Glacial acetic acid | 8 g |
| Water to make up to | 1000 ml |
| pH (25° C.) | 5.5 |

Deionized water was used throughout for the processes. Water was deionized to contain calcium and magnesium ions in an amount of not more than 3 ppm (the conductivity at 25 ° C. was 5 μs/cm).

Thus, a sample 2A was obtained. The other samples were prepared in the same manner except that the yellow coupler and an additive (color stabilizer) [50 mole % based on the amount of the coupler] contained in the first layer were changed according to the following Table 2.

Each of the samples, on which an image had been formed, was irradiated with light for 4 weeks in a fluorescent lamp fading tester at 15,000 lux. The density of the image was measured, and the remaining ratio to the density of the image (1.0) before the irradiation was obtained.

Further, the maximum reflection density (Dmax) with respect to the yellow image was measured. The relative values to the sample 2A containing no stabilizer (100) were obtained.

The results are set forth in Table 2. In the Table 2, the "Remaining Ratio" shows the results of the remaining ratio after irradiation. Further, the "Remark" indicates whether the experiment is a comparison example (Comp.) or an example of the present invention (Example).

TABLE 2

| Sample | Yellow Coupler | Stabilizer | Remaining Ratio | Relative Dmax | Remark |
|---|---|---|---|---|---|
| 2A | Y-45 | — | 78% | 100% | Comp. |
| 2B | Y-45 | (A-6) | 90% | 96% | Example |
| 2C | Y-45 | (A-12) | 92% | 100% | Example |
| 2D | Y-45 | (A-20) | 92% | 102% | Example |
| 2E | Y-45 | (A-26) | 92% | 99% | Example |
| 2F | Y-45 | (a) | 80% | 92% | Comp. |
| 2G | Y-45 | (b) | 85% | 94% | Comp. |
| 2H | Y-45 | (c) | 80% | 93% | Comp. |
| 2I | Y-49 | — | 76% | 100% | Comp. |
| 2J | Y-49 | (A-2) | 89% | 98% | Example |
| 2K | Y-49 | (A-11) | 90% | 100% | Example |
| 2L | Y-49 | (A-13) | 92% | 103% | Example |

TABLE 2-continued

| Sample | Yellow Coupler | Stabi-lizer | Remaining Ratio | Relative Dmax | Remark |
|---|---|---|---|---|---|
| 2M | Y-49 | (A-15) | 90% | 97% | Example |
| 2N | Y-49 | (A-23) | 93% | 103% | Example |
| 2O | Y-49 | (a) | 80% | 92% | Comp. |
| 2P | Y-49 | (b) | 85% | 94% | Comp. |
| 2Q | Y-49 | (d) | 82% | 90% | Comp. |
| 2R | Y-49 | (e) | 80% | 93% | Comp. |
| 2S | Y-12 | — | 77% | 100% | Comp. |
| 2T | Y-12 | (A-10) | 90% | 102% | Example |
| 2U | Y-12 | (A-28) | 92% | 103% | Example |
| 2V | Y-12 | (b) | 79% | 94% | Comp. |

It is apparent from the results that the compounds of the present invention is much effective in preventing the color image from light fading without inhibiting the color formation of the coupler, compared with the comparison compounds.

EXAMPLE 3

The experiments with respect to the samples 2A, 2B, 2K, 2L and 2N were repeated except that the yellow couplers were changed to Y-11, Y-14, Y-17, Y-15 and Y-46 respectively. As the results, it is also apparent that the compounds of the present invention is much effective in preventing the color image from fading.

EXAMPLE 4

The samples 4A to 4e were prepared in the same manner as in Example 1 except that the yellow coupler and an additive (color stabilizer) [50 mole % based on the amount of the coupler] contained in the first layer were changed according to the following Table 3.

Each of the samples, on which an image had been formed, was irradiated with light for 200 hours in a xenon tester at 200,000 lux. The density of the image was measured, and the remaining ratio to the density of the image (1.0) before the irradiation was obtained.

The stability to heat was measured by placing the samples at 100° C. for 400 hours. The remaining ratio to the density of the image (1.0) before heating was obtained. The results are set forth in Table 3.

TABLE 3

| Sample | Yellow Coupler | Stabi-lizer | Remaining Ratio Light | Remaining Ratio Heat | Remark |
|---|---|---|---|---|---|
| 4A | Y-45 | — | 69% | 80% | Comp. |
| 4B | Y-45 | (a-4) | 83% | 90% | Example |
| 4C | Y-45 | (a-6) | 85% | 91% | Example |
| 4D | Y-45 | (a-7) | 90% | 93% | Example |
| 4E | Y-45 | (a-15) | 89% | 93% | Example |
| 4F | Y-45 | (a-20) | 92% | 92% | Example |
| 4G | Y-45 | (a-34) | 88% | 92% | Example |
| 4H | Y-45 | (k) | 71% | 83% | Comp. |
| 4I | Y-45 | (b) | 69% | 82% | Comp. |
| 4J | Y-45 | (c) | 72% | 83% | Comp. |
| 4K | Y-45 | (d) | 70% | 83% | Comp. |
| 4L | Y-45 | (e) | 71% | 84% | Comp. |
| 4M | Y-10 | — | 66% | 80% | Comp. |
| 4N | Y-10 | (a-11) | 90% | 90% | Example |
| 4O | Y-10 | (a-23) | 83% | 91% | Example |
| 4P | Y-10 | (a-31) | 90% | 89% | Example |
| 4Q | Y-10 | (k) | 69% | 80% | Comp. |
| 4R | Y-10 | (e) | 72% | 84% | Comp. |
| 4S | Y-49 | — | 70% | 77% | Comp. |
| 4T | Y-49 | (a-12) | 90% | 91% | Example |
| 4U | Y-45 | (f) | 71% | 82% | Comp. |
| 4V | Y-45 | (g) | 70% | 81% | Comp. |
| 4W | Y-45 | (h) | 73% | 82% | Comp. |
| 4X | Y-45 | (i) | 69% | 80% | Comp. |
| 4Y | Y-45 | (j) | 67% | 79% | Comp. |
| 4Z | Y-49 | (f) | 73% | 78% | Comp. |
| 4a | Y-49 | (g) | 71% | 76% | Comp. |

TABLE 3-continued

| Sample | Yellow Coupler | Stabi-lizer | Remaining Ratio Light | Remaining Ratio Heat | Remark |
|---|---|---|---|---|---|
| 4b | Y-49 | (h) | 71% | 75% | Comp. |
| 4c | Y-45 | (a-12) | 90% | 91% | Example |
| 4d | Y-45 | (a-25) | 89% | 91% | Example |
| 4e | Y-45 | (a-45) | 92% | 92% | Example |

It is apparent from the results that the compounds of the present invention is much effective in preventing the color image from light fading, compared with the comparative compounds. It is also apparent that the compounds of the present invention is much effective in preventing the color image from heat fading.

(Comparative compound (k))

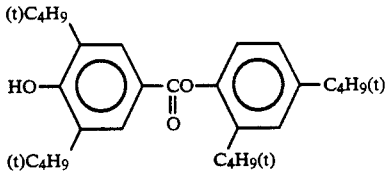

(Described in Japanese Patent Publication No. 61(1986)-20856)

(Comparative compound (f))

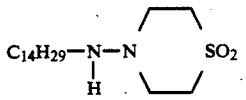

(Described in Japanese Patent Publication No. 58(1983)-50533)

(Comparative compound (g))

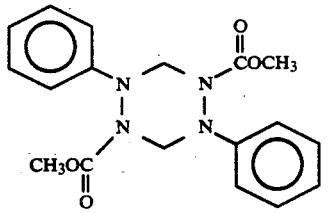

(Described in Japanese Patent Publication No. 63(1988)-299455)

(Comparative compound (h))

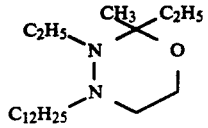

(Described in Japanese Patent Publication No. 63(1988)-256951)

(Comparative compound (i))

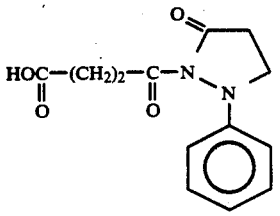

(Described in Japanese Patent Publication No. 60(1985)-47578)

(Comparative compound (j))

-continued

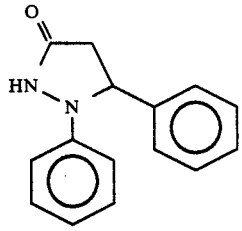

(Described in Japanese Patent Publication No. 58(1983)-50533)

EXAMPLE 5

A multilayered color photosensitive material was prepared using the silver halide emulsions (1) to (3) prepared in Example 2. The coating solution was prepared in the following manner.

PREPARATION OF COATING SOLUTION FOR THE FIRST LAYER

In 27.2 ml of methyl acetate and 3.8 ml of a solvent (Solv-1) was dissolved 19.1 g of a yellow coupler (Y-45). The solution was emulsified in 185 ml of 10% aqueous gelatin solution containing 8 ml of 10% solution of sodium dodecylbenzenesulfonate. Separately, to the silver halide emulsion (1) was added the blue sensitive spectral sensitizing dye (Sen-1) in the amount of $5.0\times10^{-4}$ mole per the 1 mole of silver. The previously prepared emulsion is mixed with the silver halide emulsion to prepare a coating solution for the first layer.

The coating solutions for the second to seventh layers were prepared in a similar manner.

As the hardening agent for the layers, sodium salt of 1-oxy-3,5-dichloro-s-triazine (hardening agent for gelatin) was used.

To the red sensitive emulsion layer was added $1.9\times10^{-3}$ mole (per 1 mole of silver halide) of the following compound.

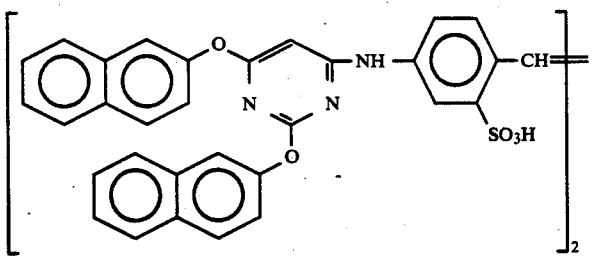

To the blue sensitive emulsion layer was added $1.0\times10^{-2}$ mole (per 1 mole of silver halide) of 4-hydroxy-6-methyl-1,3,3a,7 -tetraazaindene.

To the green sensitive emulsion layer was added $1.0\times10^{-3}$ mole (per 1 mole of silver halide) of 1-(5-methylureidophanyl)-5-mercaptotetrazole. To the green sensitive emulsion layer was added $1.5\times10^{-3}$ mole of 1-(5-methylureidophanyl)-5-mercaptotetrazole.

To the red sensitive emulsion layer was added $2.5\times10^{-4}$ mole (per 1 mole of silver halide) of 2-amino-5-mercapto-1,3,4-thiadiazole.

The composition of each of the layers set forth below. The meanings of the abbreviations and formulas for the compounds are the same as in Examples 1 and 2.

Support

Paper support (laminated with polyethylene on the both sides of paper)

[the polyethylene lamination on the side of the first layer contains white pigment ($TiO_2$) (2.7 g/m$^2$) and blue dye (ultramarine)]

| | |
|---|---|
| The first layer (Blue sensitive layer) | |
| Silver halide emulsion (1) | 0.26 |
| Gelatin | 1.13 |
| Yellow coupler (Y-45) | 0.66 |
| Solvent (Solv-4) | 0.28 |
| The second layer (Color stain inhibiting layer) | |
| Gelatin | 0.89 |
| Color stain inhibitor (Cpd-3) | 0.08 |
| Solvent (Solv-4) | 0.20 |
| Solvent (Solv-3) | 0.20 |
| Dye (T-1) | 0.005 |
| The third layer (Green sensitive layer) | |
| Silver halide emulsion (2) | 0.15 |
| Gelatin | 0.51 |
| Magenta coupler (ExM) | 0.27 |
| Color stabilizer (Cpd-5) | 0.10 |
| Color stabilizer (Cpd-8) | 0.02 |
| Color stabilizer (Cpd-9) | 0.03 |
| Solvent (Solv-3) | 0.19 |
| Solvent (Solv-5) | 0.15 |
| The fourth layer (Ultraviolet absorbing layer) | |
| Gelatin | 1.42 |
| Ultraviolet absorbent (UV-1) | 0.52 |
| Color stain inhibitor (Cpd-3) | 0.06 |
| Solvent (Solv-2) | 0.26 |
| Dye (T-2) | 0.015 |
| The fifth layer (Red sensitive layer) | |
| Silver halide emulsion (3) | 0.22 |
| Gelatin | 1.06 |
| Cyan coupler (ExC-3) | 0.37 |
| Color stabilizer (Cpd-1) | 0.32 |
| Color stabilizer (Cpd-6) | 0.18 |
| Solvent (Solv-2) | 0.10 |
| Solvent (Solv-7) | 0.10 |
| Solvent (Solv-6) | 0.11 |
| The sixth layer (Ultraviolet absorbing layer) | |
| Gelatin | 0.48 |
| Ultraviolet absorbent (UV-1) | 0.18 |
| Solvent (Solv-2) | 0.08 |
| Dye (T-2) | 0.005 |
| The seventh layer (Protective layer) | |
| Gelatin | 1.33 |
| Acrylated copolymer of polyvinyl alcohol (the acrylated ratio is 17%) | 0.05 |
| Liquid paraffin | 0.03 |

The above-prepared photosensitive material was exposed to light through an optical wedge, and subjected to the following processes.

| Process | Temperature | Time |
|---|---|---|
| Color Development | 35° C. | 45 seconds |
| Bleach-fix | 35° C. | 45 seconds |

-continued

| | | |
|---|---|---|
| Washing (1) | 35° C. | 30 seconds |
| Washing (2) | 35° C. | 30 seconds |
| Washing (3) | 35° C. | 30 seconds |
| Drying | 75° C. | 60 seconds |
| Color developing solution | | |
| Water | | 800 ml |
| Ethylenediamine-N,N,N',N'-tetramethylene-phosphonic acid | | 3.0 g |
| Triethanolamine | | 8.0 g |
| Sodium chloride | | 1.4 g |
| Potassium carbonate | | 25 g |
| Sulfonate salt of N-ethyl-N-(b-methane-sulfonamidoethyl)-3-methyl-4-aminoaniline | | 5.0 g |
| N,N-bis(carboxymethyl)hydrazine | | 5.0 g |
| Brightening agent (WHITEX4B, produced by Sumitomo Chemical Co., Ltd.) | | 1.0 g |
| Water to make up to | | 1000 ml |
| pH (25° C.) | | 10.05 |
| Bleach-fix solution | | |
| Water | | 700 ml |
| Ammonium thiosulfate solution (700 g/l) | | 100 ml |
| Ammonium sulfite | | 18 g |
| Ethylenediaminetetraacetic acid iron (III) ammonium salt | | 55 g |
| Ethylenediaminetetraacetic acid disodium salt | | 3 g |
| Ammonium bromide | | 40 g |
| Glacial acetic acid | | 8 g |
| Water to make up to | | 1000 ml |
| pH (25° C.) | | 5.5 |

Deionized water was used throughout for the processes. Water was deionized to contain calcium and magnesium ions in an amount of not more than 3 ppm (the conductivity at 25° C. was 5 μs/cm).

Thus, a sample 5A was obtained. The other samples were prepared in the same manner except that the yellow coupler and an additive (color stabilizer) [50 mole % based on the amount of the coupler] contained in the first layer were changed according to the following Table 4.

Each of the samples, on which an image had been formed, was irradiated with light for 4 weeks in a fluorescent lamp fading tester at 15,000 lux. The density of the image was measured, and the remaining ratio to the density of the image (1.0) before the irradiation was obtained.

Further, the maximum reflection density (Dmax) with respect to the yellow image was measured. The relative values to the sample 2A containing no stabilizer (100) were obtained.

The results are set forth in Table 4. In the Table 4, the "Remaining Ratio" shows the results of the remaining ratio after irradiation. Further, the "Remark" indicates whether the experiment is a comparison example (Comp.) or an example of the present invention (Example).

TABLE 4

| Sample | Yellow Coupler | Stabilizer | Remaining Ratio | Relative Dmax | Remark |
|---|---|---|---|---|---|
| 5A | Y-45 | — | 78% | 100% | Comp. |
| 5B | Y-45 | (a-6) | 92% | 96% | Example |
| 5C | Y-45 | (a-7) | 95% | 100% | Example |
| 5D | Y-45 | (a-15) | 92% | 102% | Example |
| 5E | Y-45 | (a-20) | 94% | 99% | Example |
| 5F | Y-45 | (k) | 80% | 92% | Comp. |
| 5G | Y-45 | (b) | 82% | 92% | Comp. |
| 5H | Y-45 | (c) | 81% | 93% | Comp. |
| 5I | Y-49 | — | 76% | 100% | Comp. |
| 5J | Y-49 | (a-4) | 89% | 98% | Example |
| 5K | Y-49 | (a-7) | 92% | 100% | Example |
| 5L | Y-49 | (a-11) | 93% | 103% | Example |

TABLE 4-continued

| Sample | Yellow Coupler | Stabilizer | Remaining Ratio | Relative Dmax | Remark |
|---|---|---|---|---|---|
| 5M | Y-49 | (a-31) | 90% | 100% | Example |
| 5N | Y-49 | (a-34) | 95% | 103% | Example |
| 5O | Y-49 | (k) | 80% | 92% | Comp. |
| 5P | Y-49 | (b) | 83% | 92% | Comp. |
| 5Q | Y-49 | (d) | 81% | 90% | Comp. |
| 5R | Y-49 | (e) | 80% | 93% | Comp. |
| 5S | Y-12 | — | 77% | 100% | Comp. |
| 5T | Y-12 | (a-23) | 94% | 102% | Example |
| 5U | Y-12 | (a-31) | 92% | 103% | Example |
| 5V | Y-12 | (b) | 79% | 94% | Comp. |

It is apparent from the results that the compounds of the present invention is much effective in preventing the color image from light fading without inhibiting the color formation of the coupler, compared with the comparison compounds.

EXAMPLE 6

The experiments with respect to the samples 5A, 5B, 5C, 5D, 5E, 5L, 5M, 50 and 5R were repeated except that the yellow couplers were changed to Y-10, Y-46, Y-47, Y-35 and Y-62 respectively. As the results, it is also apparent that the compounds of the present invention is much effective in preventing the color image from fading.

EFFECT OF THE INVENTION

The silver halide color photosensitive material of the present invention is characterized in that the layer containing a yellow coupler further contains a compound having the formula [I] or [II]. The photosensitive material of the invention is much improved in the stability of the photographic image.

The silver halide color photosensitive material of the present invention does not affect the color formation of a yellow coupler, and gives a yellow dye image which is stable to light, heat and humidity.

We claim:

1. A silver halide color photosensitive material comprising at least one silver halide emulsion layer on a support wherein the silver halide color photosensitive material comprises a hydrophilic colloidal layer containing a yellow coupler, wherein the layer further contains a color image stabilizer in an amount of 10 to 200 mole % based on the amount of the yellow coupler, said color image stabilizer and said yellow coupler being together contained in droplets of a medium which are dispersed in the layer, and said color image stabilizer being an organic compound containing at least two nitrogen atoms represented by the following formula (I) or (II):

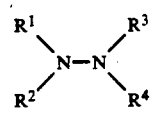

[I]

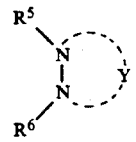

[II]

in which each of $R^1$, $R^2$, $R^3$ and $R^4$ independently is a member group selected from the group consisting of hydrogen, an alkyl group, an alkenyl group, an aryl group, a heterocyclic group, an alkoxycarbonyl group, an aryloxycarbonyl group, an acyl group, a sulfonyl group, a sulfinyl, a phosphoryl group, a carbamoyl group and a sulfamoyl group; $R^1$ and $R^2$, or $R^3$ and $R^4$ may form, together with the nitrogen atom, a 5- to 8-membered heterocyclic ring; two or more compounds having the formula (I) may be combined with each other at the position of $R^1$, $R^2$, $R^3$ or $R^4$ to form a polymer; the number of the total carbon atoms contained in $R^1$, $R^2$, $R^3$ and $R^4$ is not less than 6; neither $R^1$ and $R^2$ nor $R^3$ and $R^4$ form a heterocyclic ring which consists of

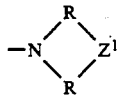

where R is an alkylene group and $Z^1$ is a sulfonyl or sulfinyl; when one of $R^1$ and $R^2$ is a hydrogen, the other one of $R^1$ and $R^2$ is not an arylsulfonyl group; and one of $R^3$ and $R^4$ is a hydrogen, the other one of $R^3$ and $R^4$ is not an arylsulfonoyl group; each of $R^1$, $R^2$, $R^3$ and $R^4$ is neither a residue of a coupler nor a residue of a reducing agent; each of one of $R^1$ and $R^2$ and one of $R^3$ and $R^4$ independently is an alkoxycarbonyl group, an aryloxycarbonyl group, an acyl group, an alkylsulfonyl group, a sulfinyl group, a phosphoryl group, a carbamoyl group or a sulfamoyl group; each of $R^5$ and $R^6$ independently is a member group selected from the group consisted of hydrogen, methyl, butyl, tert-butyl hexadecyl, phenoxyethyl, methoxyethyl, dodecyl, ethyl, octyl, a cycloalkyl group, an alkenyl group, a cycloalkenyl group, an aryl group, a heterocyclic group, an acyl group, a sulfonyl group, a phosphoryl group, a sulfinyl group, an alkylcarbamoyl group, an arylcarbamoyl group, an alkylsulfamoyl group, an arylsulfamoyl group, an alkoxycarbonyl group and an aryloxycarbonyl group, Y is a non-metallic atomic group which forms, together with the two nitrogen atoms, a 5- to 8-membered heterocyclic ring; Y does not form a heterocyclic ring which consists of

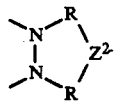

where R is an alkylene group and $Z^2$ is a heteroatom; Y does not form a perhydro-1,2,4,5-tetrazine ring; when Y forms 1-phenyl-3-pyrazolidone, neither hydrogen, acetyl nor an acyl group, which acyl group is substituted with carboxyl, is placed at the 2-position of 1-phenyl-3-pyrazolidone.

2. The silver halide color photosensitive material as claimed in claim 1, wherein when one of $R^1$, $R^2$, $R^3$ and $R^4$ in the formula is a group selected from the group consisting of an alkyl group, an aryl group and a heterocyclic group, the other three of $R^1$, $R^2$, $R^3$ and $R^4$ are not hydrogen.

3. The silver halide color photosensitive material as claimed in claim 1, wherein each of $R^1$, $R^2$, $R^3$ and $R^4$ in the formula independently contains not more than 40 carbon atoms.

4. The silver halide color photosensitive material as claimed in claim 1, wherein one of $R^5$ and $R^6$ in the formula is not hydrogen.

5. The silver halide color photosensitive material as claimed in claim 1, wherein each of $R^5$ and $R^6$ in the formula independently contains not more than 40 carbon atoms.

6. The silver halide color photosensitive material as claimed in claim 1, wherein the heterocyclic ring formed by $R^1$ and $R^2$, or $R^3$ and $R^4$ together with the nitrogen atom in the formula is a ring having a nucleus selected from the group consisting of piperidine nucleus, morpholine nucleus and pyrazolidine nucleus, each of which may have one or more substitutent groups.

7. The silver halide color photosensitive material as claimed in claim 1, wherein the heterocyclic ring formed by Y and the two nitrogen atoms in the formula is a ring having a nucleus selected from the group consisting of pyrazolidine nucleus, pyrazoline nucleus and perhydropyridadine nucleus, each of which may have one or more substituent groups.

8. The silver halide color photosensitive material as claimed in claim 1, wherein the photosensitive material further comprises a silver halide emulsion layer containing a magenta coupler and a silver halide emulsion layer containing a cyan coupler.

9. The silver halide color photosensitive material as claimed in claim 1, wherein the hydrophilic colloidal layer is a silver halide emulsion layer.

10. The silver halide color photosensitive material as claimed in claim 9, wherein the silver halide emulsion layer comprises a silver chloride or silver chlorobromide emulsion which substantially does not contain silver iodide and contains silver chloride in an amount of not less than 90 mole % based on the total amount of the silver halide.

11. The silver halide color photosensitive material as claimed in claim 10, wherein the silver chloride or silver chlorobromide emulsion contains silver chloride in an amount of not less than 95 mole % based on the total amount of the silver halide.

* * * * *